US006923660B2

(12) United States Patent
Takeuchi

(10) Patent No.: US 6,923,660 B2
(45) Date of Patent: Aug. 2, 2005

(54) ELECTRIC DISTRIBUTION BOX AND METHOD OF ASSEMBLING THE SAME

(75) Inventor: Kunihiko Takeuchi, Ogasa-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/650,741

(22) Filed: Aug. 29, 2003

(65) Prior Publication Data

US 2004/0043647 A1 Mar. 4, 2004

(30) Foreign Application Priority Data

Aug. 30, 2002 (JP) ..... P2002-255595

(51) Int. Cl.[7] ..... H01R 12/00
(52) U.S. Cl. ..... 439/76.2

(58) Field of Search ..... 439/76.2, 949; 174/59

(56) References Cited

U.S. PATENT DOCUMENTS 6,015,302 A * 1/2000 Butts et al. ..... 439/76.2
6,121,548 A * 9/2000 Matsuoka ..... 174/59

* cited by examiner

*Primary Examiner*—Ross Gushi
(74) *Attorney, Agent, or Firm*—Sughrue Mion, PLLC

(57) ABSTRACT

An electric distribution box includes a distribution box body in which interior parts are mounted and a cover attached to the distribution box body to protect the interior parts. The cover is completely fixed to the distribution box body in a first position. The cover is provisionally fixed to the distribution box body in a second position different from the first position.

12 Claims, 10 Drawing Sheets

ELECTRIC DISTRIBUTION BOX AND METHOD OF ASSEMBLING THE SAME

BACKGROUND OF THE INVENTION

This invention relates to an electric distribution box which can be assembled while interior parts, such for example as an electronic unit (electronic control unit) in an automobile and a wiring board, are positively protected, and the invention also relates to a method of assembling this electric distribution box.

FIG. 10 shows one related electric distribution box.

This electric distribution box 501 includes an upper cover 502 made of a synthetic resin, a lower cover 503 (i.e., a distribution box body), and a wire wiring board 504 and a bus bar wiring board 505 which are received between the two covers 502 and 503 in a stacked manner.

The wire wiring board 504 includes an insulating board portion 506 made of a synthetic resin, a plurality of insulating sheathed wires 507 laid on a surface of the insulating board portion 506, and terminals 508 which extend through the insulating board portion 506, and are press-contacted respectively with wires 507. A press-contacting portion 508*a* is formed at one end of the terminal 508 while a male tab-like electrical contact portion 508*b* is formed at the other end thereof.

The bus bar wiring board 505 includes an insulating board portion 509, and a plurality of bus bars 510 installed on a surface of the insulating board portion 509. The bus bar 510 has an integral male tab-like terminal 511 extending upwardly therefrom or an integral male tab-like terminal 511 extending downwardly therefrom.

The terminals 508 and 511 project into corresponding housings 512 and 513 formed at the upper cover 502 and the lower cover 503, and the terminals 508 and 511 are combined with the housings 512 and 513 to form connectors. Connectors (not shown) of external wire harnesses are connected to these connectors.

However, for example, when the lower cover 503, having the bus bar wiring board 505 and the wire wiring board 504 attached thereto, is to be transferred during the process of assembling the above related electric distribution box 501, a provisional cover (not shown) need to be attached to the lower cover 503 so as to protect the terminals 508 and others projecting from the insulating board portion 506.

Although such a provisional cover (not shown) is needed in the process of assembling the electric distribution box 501, this cover is not necessary for the electric distribution box 501 in the form of a finished product, and therefore it has been desired to omit such a provisional cover (not shown) in the process of assembling the electric distribution box 501.

And besides, when the provisional cover (not shown) is attached to the lower cover 503 in such a manner that this cover could shake relative to the lower cover 503, there is a possibility that the provisional cover (not shown) is accidentally disengaged from the lower cover 503 or dropped from the lower cover 503, and this caused an undesirable situation in which the terminals 508 and others, projecting from the insulating board portion 506, are not protected.

SUMMARY OF THE INVENTION

In view of the foregoing, it is an object of this invention to provide an electric distribution box and a method of assembling the same, in which the electric distribution box can be assembled without the need for a provisional cover or the like while interior parts, such as an electronic unit and a wiring board, are positively protected.

The above object has been achieved by an electric distribution box, comprising:

a distribution box body, in which interior parts are mounted; and a cover, attached to the distribution box body to protect the interior parts, wherein the cover is completely fixed to the distribution box body in a first position; and wherein the cover is provisionally fixed to the distribution box body in a second position different from the first position.

In the above construction, it is not necessary to beforehand prepare a provisional cover for protecting the interior parts, and the provisional cover does not need to be kept attached to the distribution box body so as to protect the interior parts, received in the distribution box body, before the electric distribution box is completely assembled by receiving the interior parts in the distribution box body. The cover is provisionally fixed to the distribution box body before the electric distribution box is completely assembled by receiving the interior parts in the distribution box body, and by doing so, the interior parts, received in the distribution box body, are protected by the cover. When the cover is completely fixed to the distribution box body, the electric distribution box is completely assembled. Therefore, in the process of assembling the electric distribution box, the provisional cover is not necessary, and therefore the interior parts are positively protected by the cover without the need for increasing the number of the component parts.

Preferably, a mounting direction of the cover relative to the distribution box body when the cover is provisionally fixed to the distribution box body, is reverse to a mounting direction of the cover relative to the distribution box body when the cover is completely fixed to the distribution box body.

With this construction, it can be easily confirmed whether all of the interior parts are contained in the distribution box body or only part of the interior parts are contained in the distribution box body.

Preferably, the cover is formed with a second engaging portion. The distribution box body is formed with a second retaining portion. The cover is provisionally fixed to the distribution box body by engaging the second engaging portion with the second retaining portion.

In this construction, the cover is hardly disengaged from the distribution box body, for example, during the transfer of the half-assembled electric distribution box. And besides, when other interior part is to be mounted in the distribution box body in which part of the interior parts is already received, the cover, provisionally fixed to the distribution box body, can be easily removed from the distribution box body without the need for much labor.

Preferably, wherein the cover is formed with a first engaging portion. The distribution box body is formed with a first retaining portion. The cover is completely fixed to the distribution box body by engaging the first engaging portion with the first retaining portion.

With this construction, the cover will not be easily removed from the distribution box body of the assembled electric distribution box. The cover is hardly removed from the distribution box body of the assembled electric distribution box, and therefore the cover, completely fixed to the distribution box body, is kept positively attached to the distribution box body.

Preferably, the cover is formed with a first guide portion. The distribution box body is formed with a first receiving portion corresponding to the first guide portion. The first guide portion is guided into the first receiving portion at the time of provisionally fixing the cover to the distribution box body. The first guide portion is guided into the first receiving portion at the time of completely fixing the cover to the distribution box body.

With this construction, when the cover is to be provisionally or completely fixed to the distribution box body, the cover is easily positioned (that is, not disposed out of position) relative to the distribution box body, and is attached thereto.

Preferably, the cover is formed with a second guide portion. The distribution box body is formed with a second receiving portion corresponding to the second guide portion. The second guide portion is deviated from the second receiving portion at the time of provisionally fixing the cover to the distribution box body. The second guide portion is guided into the second receiving portion at the time of completely fixing the cover to the distribution box body.

With this construction, at the time of provisionally or completely fixing the cover to the distribution box body, the cover is attached to the distribution box body while confirming the other guide portion formed at the cover. Therefore, the erroneous mounting of the cover on the distribution box body is prevented.

Here, it is preferable that, the second engaging portion is provided on the second guide portion. The second retaining portion is provided on a side wall of the distribution box body.

With this construction, the cover can be easily and positively provisionally fixed to the distribution box body by engaging the second engaging portion of the second guide portion of the cover with the second retaining portion formed at the side wall of the distribution box body.

Here, it is preferable that, the first retaining portion is provided on a side wall of the cover. The first engaging portion is provide on a side wall of the distribution box body.

With this construction, the cover can be easily and positively completely fixed to the distribution box body by engaging the first retaining portion of the side wall of the cover with the first engaging portion of the side wall of the distribution box body.

Preferably, a wiring board having upstanding terminals and, an electronic unit including a connector having mating terminals corresponding to the terminals, are served as the interior parts. The electronic unit is mounted on an upper side of the wiring board so that the terminals are electrically connected to the mating terminals, respectively.

With this construction, the wiring board and the electronic unit are easily and positively electrically connected together. And besides, during the process of assembling the electric distribution box, the upstanding terminals on the wiring board are positively protected by the cover provisionally-fixed to the distribution box body.

Here, it is preferable that, the terminals are formed respectively at one end portions of bus bars mounted on the wiring board, and the other end portions of the bus bars are connected to a wire installed on the wiring board so as to form electric circuits on the wiring board. The connector mounted on the electronic unit is served as a PCB connector such that a part of the mating terminals of the connector are soldered to circuit conductors on a board of the electronic unit.

With this construction, the wiring board and the electronic unit are positively electrically connected together via the terminals (formed at the one end portions of the bus bars on the wiring board) and the PCB connector mounted on the electronic unit, so that the electric circuits function.

According to the present invention, there is also provided a method of assembling an electric distribution box, comprising the steps of:

mounting a first interior part in a distribution box body;

provisionally fixing a cover to the distribution box body to protect the interior part;

removing the cover from the distribution box body;

mounting a second interior part in the distribution box body; and completely fixing the cover to the distribution box body.

In the above method, it is not necessary to beforehand prepare a provisional cover for protecting the interior parts, and the provisional cover does not need to be kept attached to the distribution box body so as to protect the interior parts, received in the distribution box body, before the electric distribution box is completely assembled by receiving the interior parts in the distribution box body. The cover is provisionally fixed to the distribution box body before the electric distribution box is completely assembled by receiving the interior parts in the distribution box body, and by doing so, the interior parts, received in the distribution box body, are protected by the cover. When the cover is completely fixed to the distribution box body, the electric distribution box is completely assembled. Therefore, in the process of assembling the electric distribution box, the provisional cover is not necessary, and therefore the interior parts are positively protected by the cover without the need for increasing the number of the component parts for assembling the electric distribution box.

Preferably, a mounting direction of the cover relative to the distribution box body in the provisionally fixing step is reverse to a mounting direction of the cover relative to the distribution box body in the completely fixing step.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An electric distribution box of the present invention, as well as a method of assembling the same, will now be described in detail with reference to the drawings.

FIGS. 1 to 5 show one preferred embodiment of the electric distribution box of the invention and the method of assembling this electric distribution box.

Various directions of the electric distribution box 1 will be described with reference to FIGS. 1 to 4.

Figure 1:
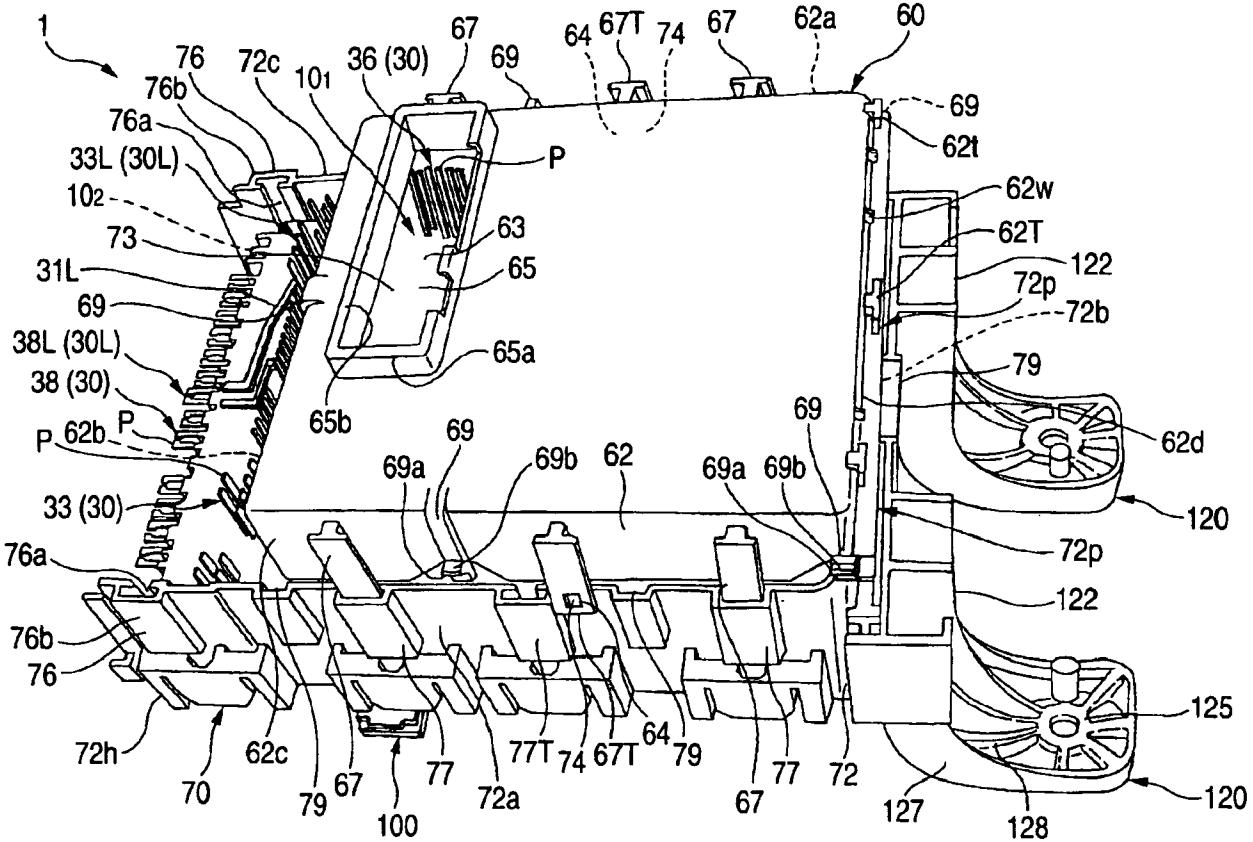
FIG. 1 is a perspective view showing one preferred embodiment of an electric distribution box of the invention and a method of assembling the same.
Figure 2:
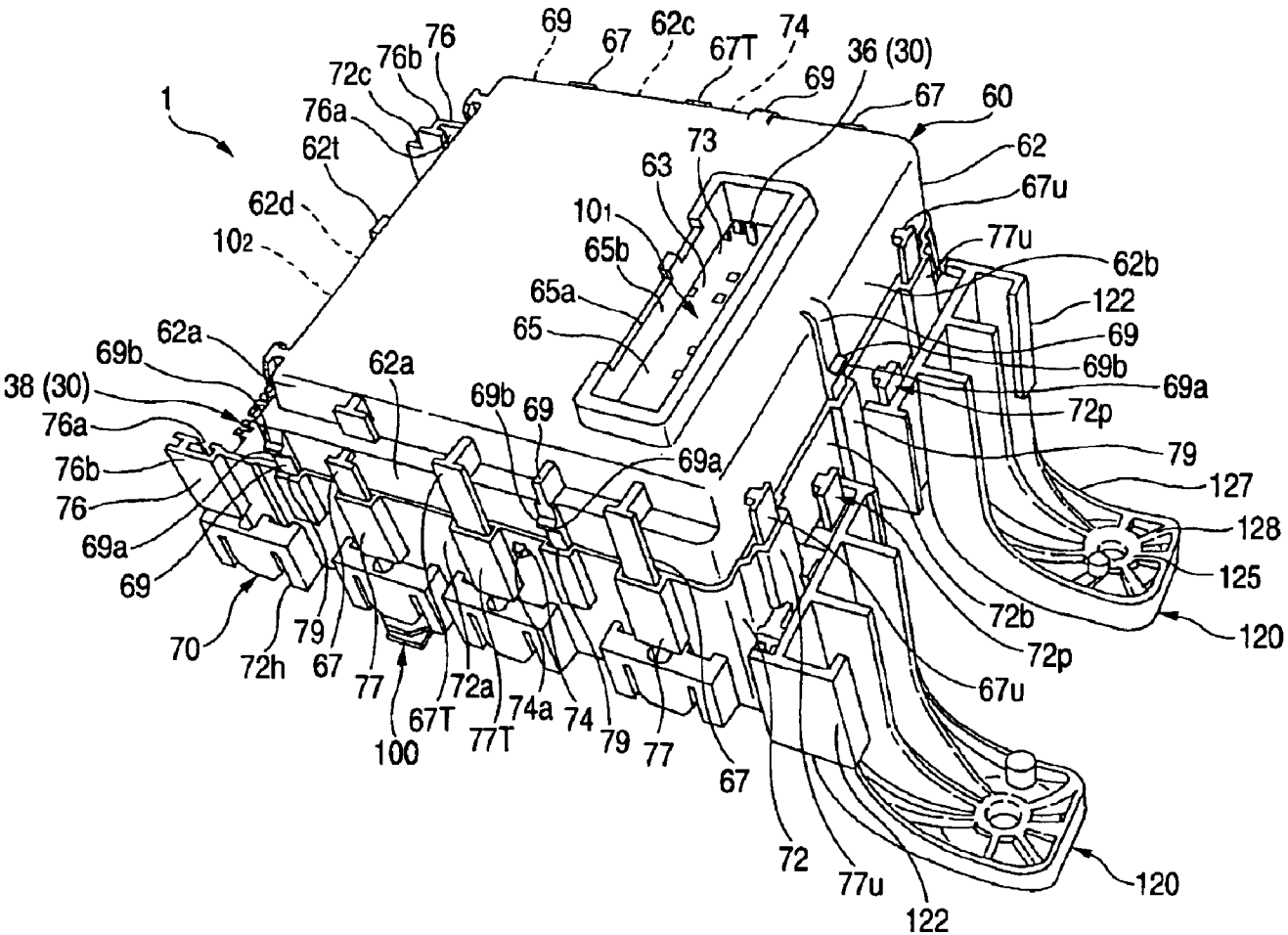
FIG. 2 is a perspective view showing a condition in which a cover is attached to the electric distribution box in a completely-retained manner.
Figure 3:
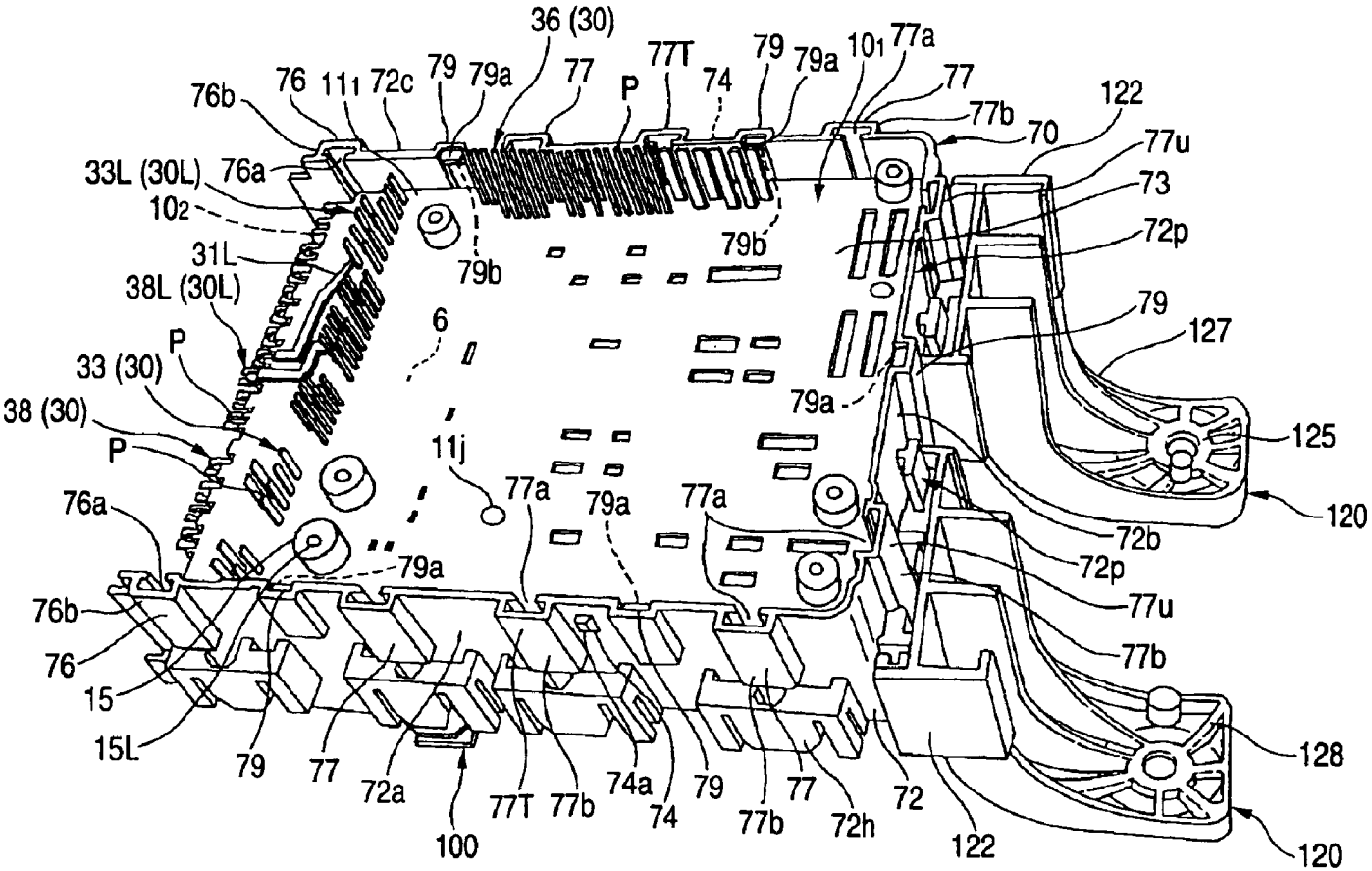
FIG. 3 is a perspective view showing a condition in which interior parts are received in a distribution box body.
Figure 4:
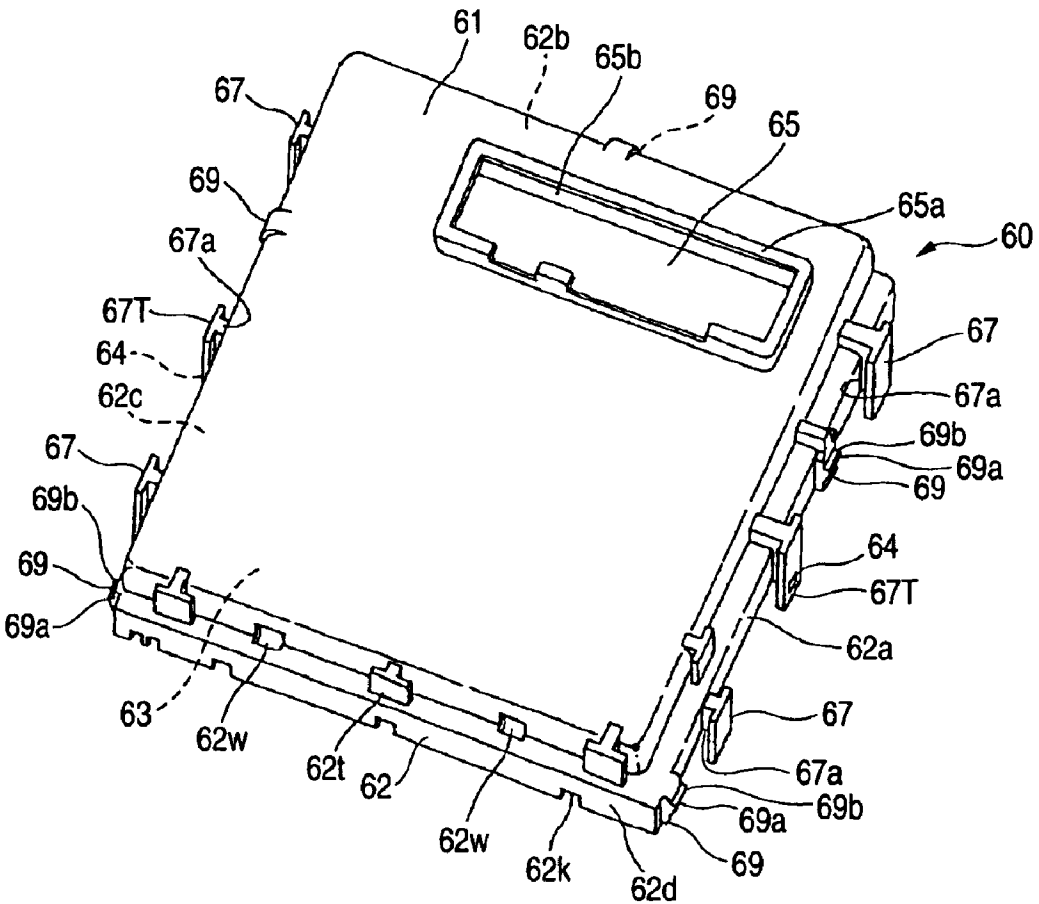
FIG. 4 is a perspective view showing an outer side of the cover.

As shown in FIGS. 1 and 2, that side at which a cover 60 is attached to a distribution box body 70 is the upper side, and that side at which support members 100 of a synthetic resin are mounted on the distribution box body 70 is the lower side. That side at which tuning-fork terminals 38 are provided at the distribution box body 70 as shown in FIG. 1 (so that a fuse block 80 (FIGS. 6 and 7) can be attached to the distribution box body 70) is the front side. That side at which a side wall 72*b* of the distribution box body 70 is disposed as shown in FIG. 2, that is, that side at which a pair of mounting members 120 are mounted on the distribution box body 70, is the rear side. As shown in FIGS. 2 and 4, that side at which projecting portions 62*t* are formed on the cover 60 is the front side of the cover 60, and that side at which an opening 65 is formed in the cover 60 is the rear side of the cover 60. As shown in FIGS. 1 to 3, the direction in which opposed side walls 72*c* and 72*a* of the distribution box body 70 face each other is a left-right direction.

In this specification, the definitions "upper and lower", "front and rear" and "right and left" are given for convenience' sake, that is, for the purpose of describing the various portions, and these do not always coincide with their corresponding directions when the electric distribution box is actually used and when the method of assembling the electric distribution box is actually performed.

The electric distribution box 1, shown in FIGS. 1 and 2, includes the distribution box body 70 (FIG. 3) which is made of a synthetic resin, and receives synthetic resin-molded wiring boards $\mathbf{10}_1$ and $\mathbf{10}_2$ (FIG. 3), an electric unit 5 (FIG. 6) and so on, and the upper cover 60 (FIGS. 1, 2, 4 and 5) which is made of a synthetic resin, and is attached to the distribution box body 70 to protect the wiring boards $\mathbf{10}_1$ and $\mathbf{10}_2$, the electronic unit 5 (FIG. 6) and so on.

As shown in FIG. 3, the distribution box body 70 has a generally-rectangular box-shape, and has a receiving portion 73 formed by a bottom wall (not shown) and the side walls 72*a*, 72*b* and 72*c* formed on a peripheral edge portion of this bottom wall (not shown).

As shown in FIGS. 2 and 3, a pair of slide guide-like attaching portions 72*p* are formed on the rear side wall 72*b* of the distribution box body 70. As shown in FIGS. 1 to 3, slide guide portions 122, corresponding respectively to the attaching portions 72*p*, are formed at the partly-curved mounting members 120, respectively. The curved mounting members 120, each having the slide guide portion 122, are detachably (slidably) mounted on the attaching portions 72*p* of the distribution box body 70, respectively.

A fixing portion 125, having a through hole, is formed at each curved mounting member 120 so that the mounting member 120 can be positively mounted on a mating mounting body (not shown). A curved portion 127 of the mounting member 120 is reinforced by ribs 128 of various shapes.

A plurality of frame-like mounting portions 72*h* are formed on each of the opposite side walls 72*a* and 72*c* of the distribution box body 70. Other mounting member (not shown) which is different in shape from the mounting members 120 (shown in FIGS. 1 to 3) is detachably attached to any one of the frame-like mounting portions 72*h* on each side wall.

The wiring board $\mathbf{10}_1$ in the form of a generally-rectangular plate is disposed at an upper layer side of the distribution box body 70, and the other wiring board $\mathbf{10}_2$ in the form of a generally-rectangular plate is disposed below the wiring board $\mathbf{10}_1$. The two wiring boards $\mathbf{10}_1$ and $\mathbf{10}_2$ are the interior parts received in the distribution box body 70.

As shown in FIG. 3, the upper wiring board $\mathbf{10}_1$ includes a flat plate-like base plate portion $\mathbf{11}_1$, and a positioning portion 11*j* in the form of a through hole is provided at the base plate portion $\mathbf{11}_1$. Male terminal portions 33 and 36 of bus bars 30 extend upwardly or upright from the flat plate-like base plate portion $\mathbf{11}_1$. As shown in FIGS. 1 and 3, in each bus bar 30L, a male tab-like terminal portion 33L is bent at a proximal end portion, and a bus bar body 31L extends, and is bent, and is continuous with a tuning-fork terminal portion 38L. The bus bars 30, 30L are coated with tin-plating.

A plurality of cylindrical fixing portions 15, each having a fixing hole $\mathbf{15}_L$, are formed on the upper surface of the base plate portion $\mathbf{11}_1$ of the wiring board $\mathbf{10}_1$ (shown in FIG. 3) SO that the electronic unit 5 (shown in FIG. 6) can be positively fixed to the upper side of the wiring board $\mathbf{10}_1$. The upper wiring board $\mathbf{10}_1$ is used as a mounting portion on which the electronic unit 5 (shown in FIG. 6) is mounted.

When the electronic unit 5 (shown in FIG. 6) is to be mounted on the upper side of the wiring board $\mathbf{10}_1$, fixing holes $\mathbf{5V}_L$, formed respectively in fixing portions 5V formed respectively on a board portion 5A of the electronic unit 5, are aligned respectively with the fixing holes $\mathbf{15}_L$ of the fixing portions 15 formed on the base plate portion $\mathbf{11}_1$ of the wiring board $\mathbf{10}_1$, and a fastening element (not shown) such as a screw is passed through each pair of aligned fixing holes $\mathbf{5V}_L$ and $\mathbf{15}_L$ of the fixing portions 5V and 15. By doing so, the electronic unit 5 (shown in FIG. 6) is positively fixed to the upper side of the wiring board $\mathbf{10}_1$ (shown in FIG. 3).

Figure 6:
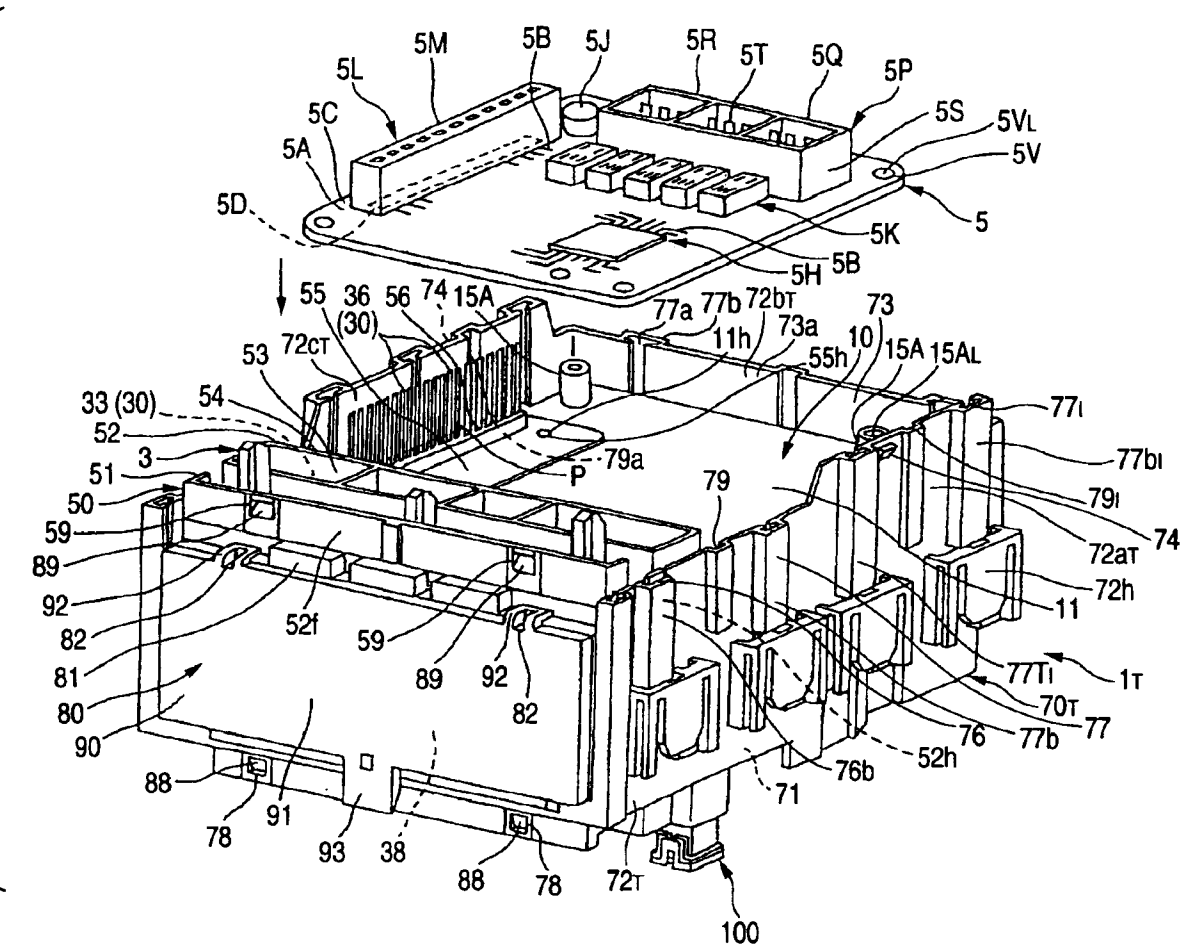
FIG. 6 is an exploded, perspective view showing another embodiment of an electric distribution box of the invention and a method of assembling the same, this Figure showing a condition in which other interior part is to be mounted in a distribution box body having interior parts received therein.

As shown in FIG. 6, the electronic unit 5 (which is the interior part 5) includes the insulating board portion (that is, a printed circuit board portion) 5A which is made of a synthetic resin, and has circuit conductors 5B printed thereon. Electric and electronic parts, including an IC package 5H, a capacitor 5J, relay connection bases 5K (to which relays (not shown) are connected), a connector 5L and another connector 5P, are mounted on the insulating board portion 5A. These parts are electrically connected via the circuit conductors made of a copper foil, thereby forming an electronic control device.

"IC" means an integrated circuit, and is an abbreviation of "Integrated Circuit". An IC is a kind of electronic circuit, and many circuit elements, such as transistors, diodes, resistors and capacitors, are associated on or within one substrate, and are interconnected by wiring, thereby forming the electronic circuit of a high-density structure.

The electronic control unit is often called "ECU". An electronic control unit includes controller controlled by a computer, and judgment means. The circuit conductors 5B, printed on the insulating board portion 5A made of a synthetic resin, are protected by an insulating coating 5C which is either transparent or translucent.

Metal terminals (not shown) are inserted in a connector housing 5M made of a synthetic resin, thereby forming the connector 5L. A rectangular opening 5D is formed through that portion of the board portion 5A disposed in registry with the lower surface of the connector 5L. With this construction, the terminal portions 36 of the bus bars 30 can be connected to the connector 5L from the lower side of this connector.

Mounting portions (not shown) of the terminals, provided in the connector 5L, are soldered respectively to the corresponding circuit conductors 5B printed on the insulating board portion 5A, and therefore are electrically connected to these circuit conductors 5B. Thus, the connector 5L, shown in FIG. 6, is used as a vertically-mounting-type connector for PCB. "PCB" means "Printed Circuit Board".

The other connector 5P includes male metal terminals 5T, and a connector housing 5Q made of a synthetic resin. The male terminals 5T are electrically connected respectively to the corresponding circuit conductors 5B printed on the insulating board portion 5A.

Figure 5:
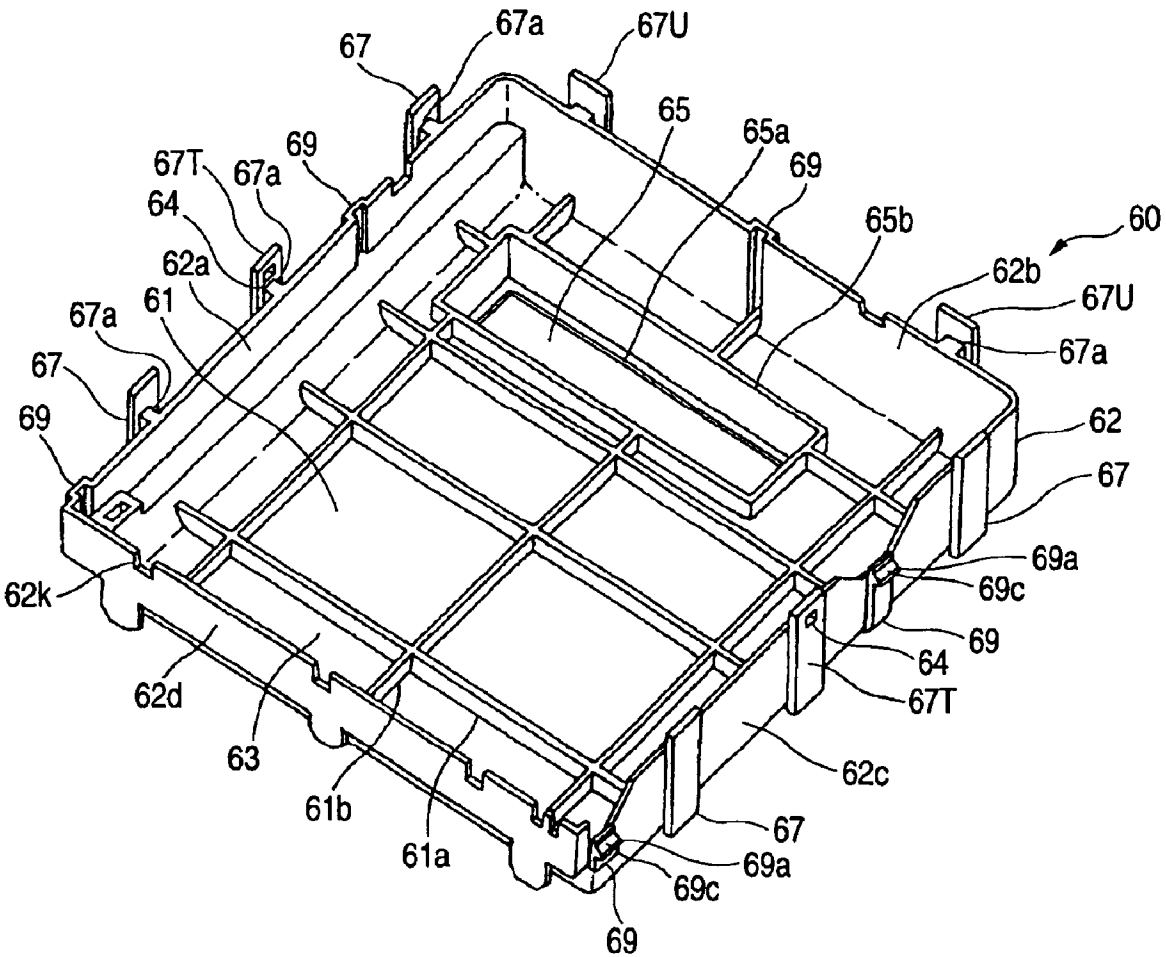
FIG. 5 is a perspective view showing an inner side of the cover.

As shown in FIGS. 4 and 5, a plurality of guide portions 67, 67T and 67U (FIG. 5) are formed on a peripheral wall 62 of the upper cover 60, and a plurality of guide receiving portions 77, 77T and 77U, corresponding respectively to the guide portions 67, 67T and 67U, are formed on a peripheral wall 72 of the distribution box body 70 as shown in FIG. 3.

As shown in FIG. 3, each of the guide receiving portions 77, 77T and 77U of the distribution box body 70 has a guide groove 77, 77T, 77U of a generally T-shaped cross-section, and each of the guide portions 67, 67T and 67U of the upper cover 60 includes a plate-like guide piece portion 67, 67T, 67U (FIG. 5) corresponding to the guide groove 77, 77T, 77U as shown in FIGS. 4 and 5.

Support portions 67*a* are formed on and project outwardly from the peripheral wall 62 of the upper cover 60, and the guide piece portions 67, 67T and 67U of the upper cover 60 are formed on outer edges of these support portions 67*a*, respectively. As shown in FIG. 3, each of the guide receiving portions 77, 77T and 77U of the distribution box body 70 includes a frame portion 77*b* extending outwardly from the peripheral wall 72 of the distribution box body 70, and an elongate narrow groove 77*a* (FIG. 3) corresponding to the support portion 67*a* of the upper cover 60 shown in FIGS. 4 and 5.

As shown in FIGS. 4 and 5, completely-retaining portions 69 (each having a completely-retaining projection 69*a*) are provided on side walls 62*a*, 62*b* and 62*c* of the upper cover 60. Completely-engaging portions 79 (each having a completely-engaging projection 79*a*), corresponding respectively to the completely-retaining portions 69, are provided on the side walls 72*a*, 72*b* and 72*c* of the distribution box body 70 shown in FIG. 3.

As shown in FIGS. 4 and 5, the upper cover 60 includes a generally-rectangular top wall 61, and side walls 62*a*, 62*b*, 62*c* and 62*d* formed at a peripheral edge portion of the top wall 61. The upper cover 60 has a receiving portion 63 therein as shown in FIG. 5. A generally-rectangular opening 65, corresponding to the connector 5P of the electronic unit 5, is formed through the top wall 61 of the upper cover 60 as shown in FIGS. 4 and 5.

As shown in FIGS. 4 and 5, a rib 65*a* is formed at a peripheral edge of the opening 65 in the upper cover 60. A guide rib 65*b* extends from the rib 65*a* (formed at the peripheral edge of the opening 65 in the upper cover 60) into the interior of the upper cover 60. The rib 65*a* corresponds in shape to an upper end portion 5R of the connector housing 5Q of the connector 5P shown in FIG. 6. The guide rib 65*b*, shown in FIGS. 4 and 5, corresponds in shape to a side wall portion 5S of the connector housing 5Q of the connector 5P shown in FIG. 6.

As shown in FIG. 4, a plurality of generally T-shaped projections 62*t* are formed on the side wall 62*d* of the upper cover 60, and also a pair of windows 62*w* are formed in this side wall 62*d*. As shown in FIG. 5, ribs 61*a* and 61*b* which intersect one another lengthwise and widthwise are formed on the inner surface of the top wall 61 of the upper cover 60 to increase the strength of the upper cover 60.

In this electric distribution box 1, the cover 60 can be completely fixed to the distribution box body 70 in a normal position as shown in FIG. 2. Also, in this electric distribution box 1, the cover 60 can be provisionally fixed to the distribution box body 70 in a position different from the normal position as shown in FIG. 1.

With this construction of the electric distribution box 1, it is not necessary to beforehand prepare a provisional cover (not shown) for protecting the group of terminals 36 and so on, provided on the wiring board $\mathbf{10}_1$ (FIG. 3), during the assembling process of the electric distribution box 1, and the provisional cover (not shown) does not need to be kept attached to the distribution box body 70 to protect the group of terminals 36 and so on (provided on the wiring board $\mathbf{10}_1$ received in the distribution box body 70) before the electric distribution box 1 is completely assembled by receiving the wiring boards $\mathbf{10}_1$ and $\mathbf{10}_2$, the electronic unit 5 (shown in FIG. 6) and so on in the distribution box body 70.

As shown in FIG. 1, the cover 60 is provisionally fixed to the distribution box body 70 until the assembling of the electric distribution box 1 is finished after the wiring boards $\mathbf{10}_1$ and $\mathbf{10}_2$, the electronic unit 5 (shown in FIG. 6) and so on are received in the distribution box body 70 (shown in FIG. 3). Therefore, the group of terminals 36 and so on, provided on the wiring board $\mathbf{10}_1$ received in the distribution box body 70, are protected by the cover 60.

As shown in FIG. 2, the cover 60 is completely fixed to the distribution box body 70, thereby completely assembling the electric distribution box 1. Therefore, the provisional cover (not shown) is not needed in the process of assembling the electric distribution box 1. By doing so, the group of terminals 36 and so on, provided on the wiring board $\mathbf{10}_1$ (shown in FIGS. 1 to 3), are more positively protected without the need for increasing the number of the component parts in the process of assembling the electric distribution box 1.

The electric distribution box 1, shown in FIG. 2, is in a condition immediately before the cover 60 is completely fixed to the distribution box body 70. When the electric distribution box 1 is actually assembled, a housing member 50 (shown in FIGS. 6 and 8), the electronic unit 5 (shown in FIG. 6) and the fuse block 80 (shown in FIGS. 6 and 7) are attached to the distribution box body 70 shown in FIG. 2.

The cover 60 (shown in FIGS. 4 and 5), the electronic unit 5 (shown in FIG. 6), the housing member 50 (shown in FIG. 8) and the fuse block 80 (shown in FIGS. 6 and 7) can be used for both of one embodiment of the electric distribution box (and the method of assembling the same) of FIGS. 1 to 3 and another embodiment of FIGS. 6 to 9.

Figure 8:
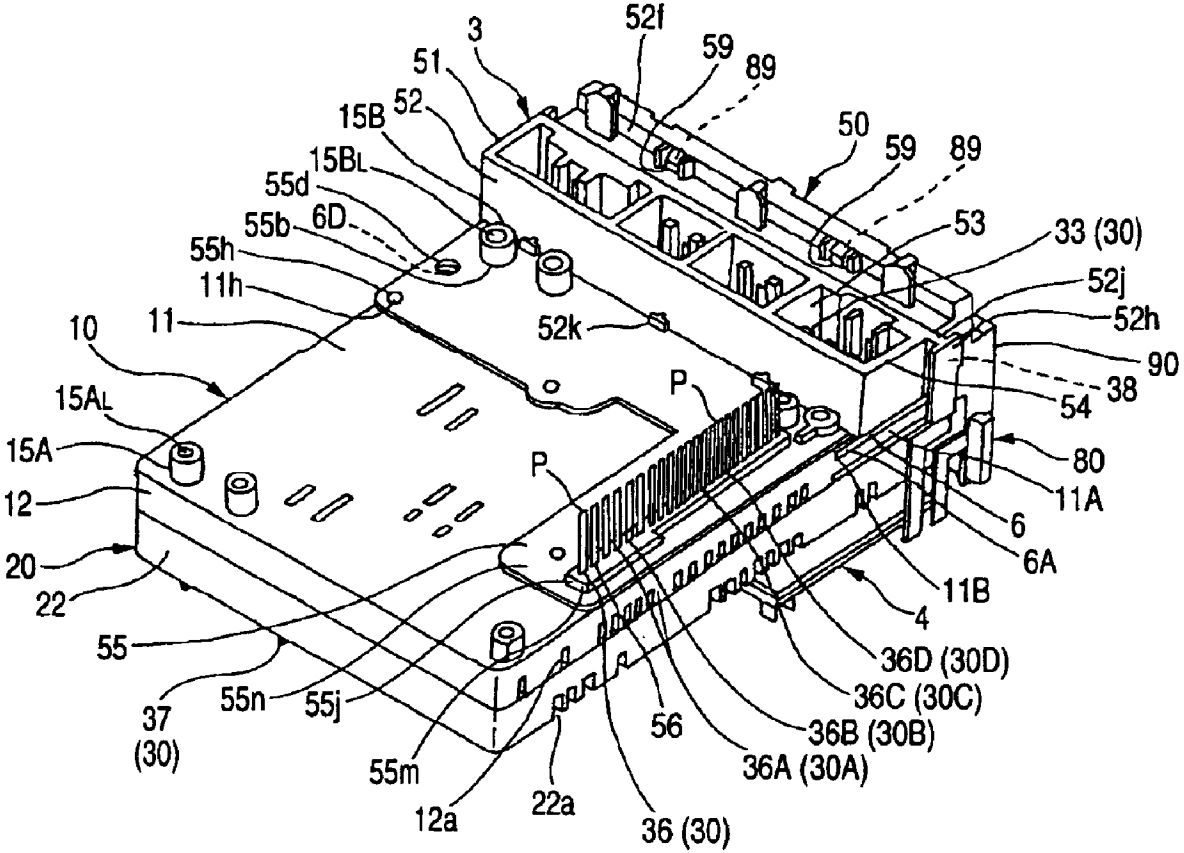
FIG. 8 is a perspective view showing the interior parts.

As shown in FIG. 8, guide portions 52*h* are formed at the opposite ends of the housing member 50, respectively, and guide receiving portions 76, corresponding respectively to these guide portions 52*h*, are formed respectively at the front end portions of the opposed side walls 72*a* and 72*c* of the distribution box body 70 as shown in FIG. 3. Each of the guide receiving portions 76 of the distribution box body 70 has a guide groove 76 of a generally T-shaped cross-section, and each of the guide portions 52*h* of the housing member 50 includes a plate-like guide piece portion 52*h* corresponding to the guide groove 76, as shown in FIG. 8. Support portions 52*j* are formed on and project outwardly from the peripheral wall 52 of the housing member 50, and the guide piece portions 52*h* of the housing member 50 are formed on outer edges of these support portions 52*j*, respectively.

As shown in FIG. 3, each of the guide receiving portions 76 of the distribution box body 70 includes a frame portion 76*b* extending outwardly from the side wall 72*a*, 72*c* of the distribution box body 70, and an elongate narrow groove 76*a* (FIG. 3) corresponding to the support portion 52*j* (FIG. 8) of the housing member 50.

The mounting direction of the cover 60, provisionally fixed to the distribution box body 70 (as shown in FIG. 1), is reverse to the mounting direction of the cover 60 completely fixed to the distribution box body 70 (as shown in FIG. 2), that is, the two mounting directions are 180 degrees opposite to each other with respect to the forward-rearward direction.

With this construction of the electric distribution box 1, it can be easily confirmed from the condition of FIG. 1 that the electronic unit 5 (shown in FIG. 6) is not yet mounted on the wiring board $\mathbf{10}_1$ although the wiring boards $\mathbf{10}_1$ and $\mathbf{10}_2$ are received in the distribution box body 70, and also it can be easily confirmed from the condition of FIG. 2 that all the necessary interior parts are received in the distribution box body 70, with the electronic unit 5 (shown in FIG. 6) already mounted on the wiring board $\mathbf{10}_1$ (shown in FIG. 3).

When a pair of provisionally-engaging portions 64, formed on the cover 60 (shown in FIGS. 4 and 5), are engaged respectively with a pair of provisionally-retaining portions 74 formed on the distribution box body 70 (shown in FIG. 3), the cover 60 is provisionally fixed to the distribution box body 70 as shown in FIG. 1. More specifically, when the cover 60 is to be provisionally fixed to the distribution box body 70, the pair of other guide piece portions 67T of the cover 60 (shown in FIGS. 4 and 5) slide respectively over the pair of provisionally-retaining projections 74 of the distribution box body 70 (shown in FIG. 3), and the pair of provisionally-engaging holes 64 in the cover 60 (shown in FIGS. 4 and 5) are engaged respectively with the pair of provisionally-retaining projections 74 of the distribution box body 70, so that the cover 60 (shown in FIG. 1) is provisionally fixed to the distribution box body 70 (shown in FIG. 1).

As shown in FIGS. 2 and 3, a slanting sliding-contact surface 74*a* is formed on each provisionally-retaining projection 74 of the distribution box body 70. This slanting sliding-contact surface 74*a* is formed on the provisionally-retaining projection 74 to enable the cover 60 to be easily removed from the distribution box body 70. The provisionally-retaining portion 74 and the provisionally-engaging portion 64 can be easily brought into and out of engagement with each other, and therefore jointly is performed by a semi-lock process.

When the cover 60 is thus provisionally fixed to the distribution box body 70, the cover 60 is hardly disengaged from the distribution box body 70, for example, during the transfer of the half-assembled electric distribution box 1 (FIG. 1). And besides, when the electronic unit 5 (FIG. 6) is to be mounted on the wiring board $\mathbf{10}_1$ (beforehand received in the distribution box body 70) in the next assembling step, the cover 60 (FIG. 1), provisionally fixed to the distribution box body 70, can be easily removed from the distribution box body 70 without the need for much labor (FIG. 3).

When the cover 60 is provisionally fixed to the distribution box body 70 as shown in FIG. 1, there is not encountered an undesirable situation in which the completely-retaining portions 69 of the cover 60 are engaged respectively with the completely-engaging portions 79 of the distribution box body 70. When the cover 60 is provisionally fixed to the distribution box body 70, the completely-engaging portions 79 of the distribution box body 70 are disposed out of registry with the completely-retaining portions 69 of the cover 60, respectively, so that the cover 60 will not be completely fixed to the distribution box body 70.

According to the specification of the electric distribution box, the provision of the semi-lock means on the electric distribution box can be omitted. According to the specification of the electric distribution box and the production line for assembling the electric distribution box, the electric distribution box may be assembled without provisionally fixing the cover 60 to the distribution box body 70. However, when the electric distribution box is transferred in this condition, there is a fear that the cover 60 is disengaged from the distribution box body 70, for example, because of vibrations. In order to avoid such a trouble, provisionally-fastening means (not shown), such for example as a rubber band, may be used to provisionally fix the cover to the distribution box body.

When the completely-retaining portions 69 of the cover 60 (shown in FIGS. 4 and 5) are engaged respectively with the completely-engaging portions 79 of the distribution box body 70 (shown in FIG. 3), the cover 60 is completely fixed to the distribution box body 70 as shown in FIG. 2. More specifically, when a retaining surface 69*b* (FIG. 4) of each completely-retaining projection 69*a* of the cover 60 (shown in FIGS. 4 and 5) is engaged with an engaging surface 79*b* of a corresponding completely-engaging projection 79*a* of the distribution box body 70 (shown in FIG. 3), the cover 60 (shown in FIG. 2) is completely fixed to the distribution box body 70 (shown in FIG. 2).

As shown in FIG. 5, a slanting sliding-contact surface 69*c* is formed on each completely-retaining projection 69*a* of the cover 60, and therefore when the cover 60 is to be completely fixed to the distribution box body 70 as shown in FIG. 2, each completely-retaining projection 69*a* of the cover 60 (shown in FIG. 5) can easily slide over the corresponding completely-engaging projection 79*a* of the distribution box body 70 (shown in FIG. 3). The completely-retaining portion 69 and the completely-engaging portion 79, once engaged with each other, can not be easily disengaged from each other, and therefore jointly form complete lock means.

When the cover 60 is thus completely fixed to the distribution box body 70, the cover 60 will not be easily removed from the distribution box body 70 of the assembled electric distribution box 1. In the assembled electric distribution box 1, it is seldom required to remove the cover 60 from the distribution box body 70, and therefore by completely fixing the cover 60 to the distribution box body 70, the cover 60 is positively kept attached to the distribution box body 70.

As shown in FIGS. 4 and 5, the guide portions 67 are formed respectively at four corner portions of the peripheral wall 62 of the cover 60. As shown in FIG. 3, the guide receiving portions 77, corresponding respectively to the guide portions 67, are formed respectively at four corner portions of the peripheral wall 72 of the distribution box body 70.

At the time of provisionally fixing the cover 60 to the distribution box body 70 as shown in FIG. 1, the four guide portions 67, formed on the cover 60, are disposed in registry with the four guide receiving portions 77, formed on the distribution box body 70, respectively. The cover 60, shown in FIG. 1, is turned through 180 degrees with respect to the forward-rearward direction, and at the time of completely fixing the cover 60 to the distribution box body 70 as shown in FIG. 2, the four guide portions 67, formed on the cover 60, are disposed in registry with the four guide receiving portions 77, formed on the distribution box body 70, respectively.

With this construction of the electric distribution box 1, at the time of provisionally fixing the cover 60 to the distribution box body 70 as shown in FIG. 1 and also at the time of completely fixing the cover 60 to the distribution box body 70 as shown in FIG. 2, the cover 60 is easily positioned (that is, not disposed out of position) relative to the distribution box body 70, and is attached thereto.

As shown in FIGS. 4 and 5, the pair of other guide portions 67T are formed on the cover 60. The other guide portions 67T of the cover 60 are formed upright at generally central portions (in the forward-rearward direction) of the opposite side walls 62*a* and 62*c* of the cover 60, respectively. As shown in FIG. 3, the pair of other guide receiving portions 77T, corresponding respectively to the pair of other guide portions 67T, are formed on the distribution box body 70. The other guide receiving portions 77T of the distribution box body 70 are formed in a projected manner at generally central portions (in the forward-rearward direction) of the opposite side walls 72*a* and 72*c* of the distribution box body 70, respectively.

At the time of provisionally fixing the cover 60 to the distribution box body 70 as shown in FIG. 1, the pair of other guide portions 67T, formed on the cover 60, are disposed out of registry with the pair of other guide receiving portions 77T, formed on the distribution box body 70, respectively. The cover 60, shown in FIG. 1, is turned through 180 degrees with respect to the forward-rearward direction, and at the time of completely fixing the cover 60 to the distribution box body 70 as shown in FIG. 2, the pair of other guide portions 67T, formed on the cover 60, are disposed in registry with the pair of other guide receiving portions 77T, formed on the distribution box body 70, respectively.

As shown in FIGS. 2 and 5, the pair of further guide portions 67U are formed on the cover 60. The pair of further guide portions 67U are formed upright on the rear side wall 62*b* of the cover 60. The pair of further guide receiving portions 77U, corresponding respectively to the pair of further guide portions 67U, are formed on the distribution box body 70 as shown in FIGS. 2 and 3. The pair of further guide receiving portions 77U are formed in a projected manner on the rear side wall 72*b* of the distribution box body 70.

At the time of provisionally fixing the cover 60 to the distribution box body 70 as shown in FIG. 1, the pair of further guide portions 67U (FIG. 5), formed on the cover 60, are disposed out of registry with the pair of further guide receiving portions 77U (FIG. 3), formed on the distribution box body 70, respectively. The cover 60, shown in FIG. 1, is turned through 180 degrees with respect to the forward-rearward direction, and at the time of completely fixing the cover 60 to the distribution box body 70 as shown in FIG. 2, the pair of further guide portions 67U, formed on the cover 60, are disposed in registry with the pair of further guide receiving portions 77U, formed on the distribution box body 70, respectively.

With this construction of the electric distribution box 1, at the time of provisionally fixing the cover 60 to the distribution box body 70 as shown in FIG. 1 and also at the time of completely fixing the cover 60 to the distribution box body 70 as shown in FIG. 2, the cover 60 is attached to the distribution box body 70 while confirming the attached condition of the pair of other guide portions 67T (formed on the cover 60) and the attached condition of the pair of further guide portions 67U formed on the cover 60. Therefore, the erroneous mounting of the cover 60 on the distribution box body 70 in the forward-rearward direction is easily prevented.

As shown in FIGS. 4 and 5, the provisionally-engaging hole 64 (in the form of a generally-rectangular through hole) is formed in each of the pair of guide portions 67T formed respectively on the side walls 62*a* and 62*c* of the cover 60 in a projected manner. As shown in FIG. 3, the provisionally-retaining projection 74 is formed on the outer surface of each of the pair of side walls 72*a* and 72*c* of the distribution box body 70 at an upper portion thereof.

The electric distribution box 1 includes the cover 60, having the provisionally-engaging holes 64, and the distribution box body 70 having the provisionally-retaining projections 74, and therefore when the provisionally-engaging holes 64, formed respectively in the other guide portions 67T formed in a projected manner on the cover 60, are engaged respectively with the provisionally-retaining projections 74 formed respectively on the side walls 72*a* and 72*c* of the distribution box body 70, the cover 60 is easily and positively provisionally fixed to the distribution box body 70 as shown in FIG. 1.

As shown in FIGS. 4 and 5, the completely-retaining portions 69 are formed on the side walls 62*a* to 62*c* of the cover 60, and the completely-retaining projection 69*a* is formed on each of the completely-retaining portions 69. As shown in FIG. 3, the completely-engaging projections 79*a*, corresponding respectively to the completely-retaining projections 69*a* formed respectively on the completely-retaining portions 69, are formed respectively In the completely-engaging groove portions 79 formed at the side walls 72*a* to 72*c* of the distribution box body 70.

The electric distribution box 1 includes the cover 60, having the completely-retaining projections 69*a*, and the distribution box body 70 having the completely-retaining projections 79*a*, and therefore when the completely-retaining projections 69*a* on the side walls 62*a* to 62*c* of the cover 60 are engaged respectively with the completely-engaging projections 79*a* in the completely-engaging groove portions 79 on the side walls 72*a* to 72*c* of the distribution box body 70, the cover 60 is easily and positively completely fixed to the distribution box body 70 as shown in FIG. 2.

When the cover 60 is to be completely fixed (that is, completely locked) to the distribution box body 70, the three guide grooves 77, 77T and 77, provided at the side wall 72*a* of the distribution box body 70, are disposed in registry with the three guide piece portions 67, 67T and 77, formed on the side wall 62*a* of the cover 60, respectively, as shown in FIG. 2, and also the three guide grooves 77, 77T and 77, provided at the side wall 72*c* of the distribution box body 70, are disposed in registry with the three guide piece portions 67, 67T and 77, formed on the side wall 62C of the cover 60, respectively, as shown in FIGS. 3 to 5, and also the two guide grooves 77U and 77U, provided at the rear side wall 72*b* of the distribution box body 70, are disposed in registry with the two guide piece portions 67U and 67U, formed on the rear side wall 62*b* of the cover 60, respectively, as shown in FIG. 2.

In this condition, when the cover 60 is pressed down relative to the distribution box body 70, the completely-retaining projections 69*a* (FIG. 2) of the cover 60 are brought into engagement respectively with the completely-engaging projections 79*a* (FIG. 3) provided respectively in the completely-engaging groove portions 79 of the distribution box body 70. As a result, the cover 60 is positively completely locked to the distribution box body 70 such that the cover 60 can not be easily disengaged from the distribution box body 70.

The procedure of assembling the electric distribution boxes 1 and $\mathbf{1}_T$ (shown in FIGS. 1, 2, 6 and 7) will be described. First, the wiring boards $\mathbf{10}_1$ and $\mathbf{10}_2$ are received in the distribution box body 70 as shown in FIG. 3. Then, the cover 60 is provisionally fixed to the distribution box body 70 to protect the group of terminals 36 provided at the wiring boards $\mathbf{10}_1$ and $\mathbf{10}_2$ as shown in FIG. 1. After the electric distribution box 1, shown in FIG. 1, is transferred to the site of the next assembling step, the cover 60 is removed from the distribution box body 70.

The assembling procedure for the electric distribution box $\mathbf{1}_T$, transferred to the above next assembling site, will be described below.

FIGS. 4 to 9 show another embodiment of the electric distribution box of the invention and the method of assembling the same.

Comparing the distribution box body 70 of FIG. 3 with the distribution box body $\mathbf{70}_T$ of FIG. 6, the side walls 72*a*, 72*b* and 72*c* (shown in FIG. 3), forming the peripheral wall 72 of the distribution box body 70, are partially different from side walls $\mathbf{72}a_T$, $\mathbf{72}b_T$ and $\mathbf{72}c_T$ (shown in FIG. 6) forming a peripheral wall $\mathbf{72}_T$ of the distribution box body $\mathbf{70}_T$.

The side walls 72*a* to 72*c* of the distribution box body 70 (shown in FIG. 3) are generally equal in height, but the side walls $\mathbf{72}a_T$, $\mathbf{72}b_T$ and $\mathbf{72}c_T$ of the distribution box body $\mathbf{70}_T$ (shown in FIG. 6) are not equal in height, and rear end portions of the opposite (left and right) side walls $\mathbf{72}a_T$ and $\mathbf{72}c_T$ are slightly higher. In order that a plurality of terminal portions 36 can be positively protected by the distribution box body $\mathbf{70}_T$, the upper end of that portion of the side wall $\mathbf{72}c_T$, corresponding to the plurality of juxtaposed terminal portions 36, is made higher, and the side walls $\mathbf{72}a_T$ and $\mathbf{72}c_T$ of the distribution box body $\mathbf{70}_T$ are asymmetrical.

Therefore, guide receiving portions $\mathbf{77}_I$ (FIG. 6) each having a frame portion $\mathbf{77}b_I$, other guide receiving portions $\mathbf{77}\mathrm{T}_I$ (FIG. 6) and completely-retaining portions $\mathbf{79}_I$ (FIG. 6) are larger in height than the guide receiving portions 77 (FIG. 3) each having the frame portion 77*b*, the other guide receiving portions 77T (FIG. 3) and the completely-retaining portions 79 (FIG. 3), respectively.

The distribution box body 70 (shown in FIG. 3) has been compared with the distribution box body $\mathbf{70}_T$ (shown in FIG. 6), and the difference between the two have been described. With respect to the other portions, the distribution box body 70 (shown in FIG. 3) and the distribution box body $\mathbf{70}_T$ (shown in FIG. 6) have generally the same construction.

Comparing the wiring board $\mathbf{10}_1$ (shown in FIG. 3) with a wiring board 10 (shown in FIG. 8), the base plate portion $\mathbf{11}_1$ of the wiring board $\mathbf{10}_1$ (FIG. 3) is different in shape from a base plate portion 11 and other base plate portion 11A of the wiring board 10 (FIG. 8), and the two wiring boards are different from each other in the position of mounting of a power module 6. However, with respect to the other portions, the wiring board $\mathbf{10}_1$ (shown in FIG. 3) and the wiring board 10 (shown in FIG. 8) have generally the same construction.

Thus, a comparison between the electric distribution box 1 (shown in FIGS. 1 and 2) and the electric distribution box $\mathbf{1}_T$ (shown in FIGS. 6 and 7) indicates that although the distribution box bodies 70 and $\mathbf{70}_T$, as well the wiring boards 10 and $\mathbf{10}_1$, are partially different from each other, the electric distribution box 1 (shown in FIGS. 1 and 2) and the electric distribution box $\mathbf{1}_T$ (shown in FIGS. 6 and 7) has generally the same form. In FIGS. 6 to 9, those portions similar to those of FIGS. 1 to 3 will be designated by identical reference numerals, and detailed explanation thereof will be omitted.

The assembling procedure for the electric distribution box $\mathbf{1}_T$, transferred to the above next assembling site, will be described below. The cover 60 is removed from the distribution box body $\mathbf{70}_T$, and a fuse block 80 is attached to this distribution box body $\mathbf{70}_T$ as shown in FIG. 6. A housing member 50 (shown in FIG. 8) is mounted on the wiring board 10 received in the distribution box body $\mathbf{70}_T$ from which the cover 60 has been removed. Thereafter, an electronic unit 5 is mounted on the wiring board 10, and is electrically connected thereto as shown in FIG. 6. After all of the interior parts are mounted on the distribution box body $\mathbf{70}_T$, the cover 60 is completely fixed to the distribution box body $\mathbf{70}_T$, thereby completely assembling the electric distribution box $\mathbf{1}_T$ as shown in FIG. 7.

The electric distribution box $\mathbf{1}_T$ is assembled according to this procedure. Therefore, it is not necessary to beforehand prepare a provisional cover (not shown) for protecting the group of terminals 36 and so on provided on the wiring board 10 (FIG. 6), and the provisional cover (not shown) does not need to be kept attached to the distribution box body $\mathbf{70}_T$ to protect the group of terminals 36 and so on (provided on the wiring board 10 received in the distribution box body $\mathbf{70}_T$) before the electric distribution box $\mathbf{1}_T$ is completely assembled by receiving the wiring boards 10 and 20 (shown in FIGS. 8 and 9), the housing member 50 (shown in FIG. 8), the electronic unit 5 (shown in FIG. 6) and so on in the distribution box body $\mathbf{70}_T$.

The cover 60 (shown in FIGS. 4 and 5) is provisionally fixed to the distribution box body $\mathbf{70}_T$ (shown in FIG. 6) before the electric distribution box $\mathbf{1}_T$ is completely assembled by receiving the wiring boards 10 and 20 (shown in FIGS. 8 and 9), the electronic unit 5 (shown in FIG. 6) and so on in the distribution box body $\mathbf{70}_T$, and by doing so, the group of terminals 36 and so on, provided on the wiring board 10 received in the distribution box body $\mathbf{70}_T$ (FIG. 6), are protected by the cover 60.

Figure 7:
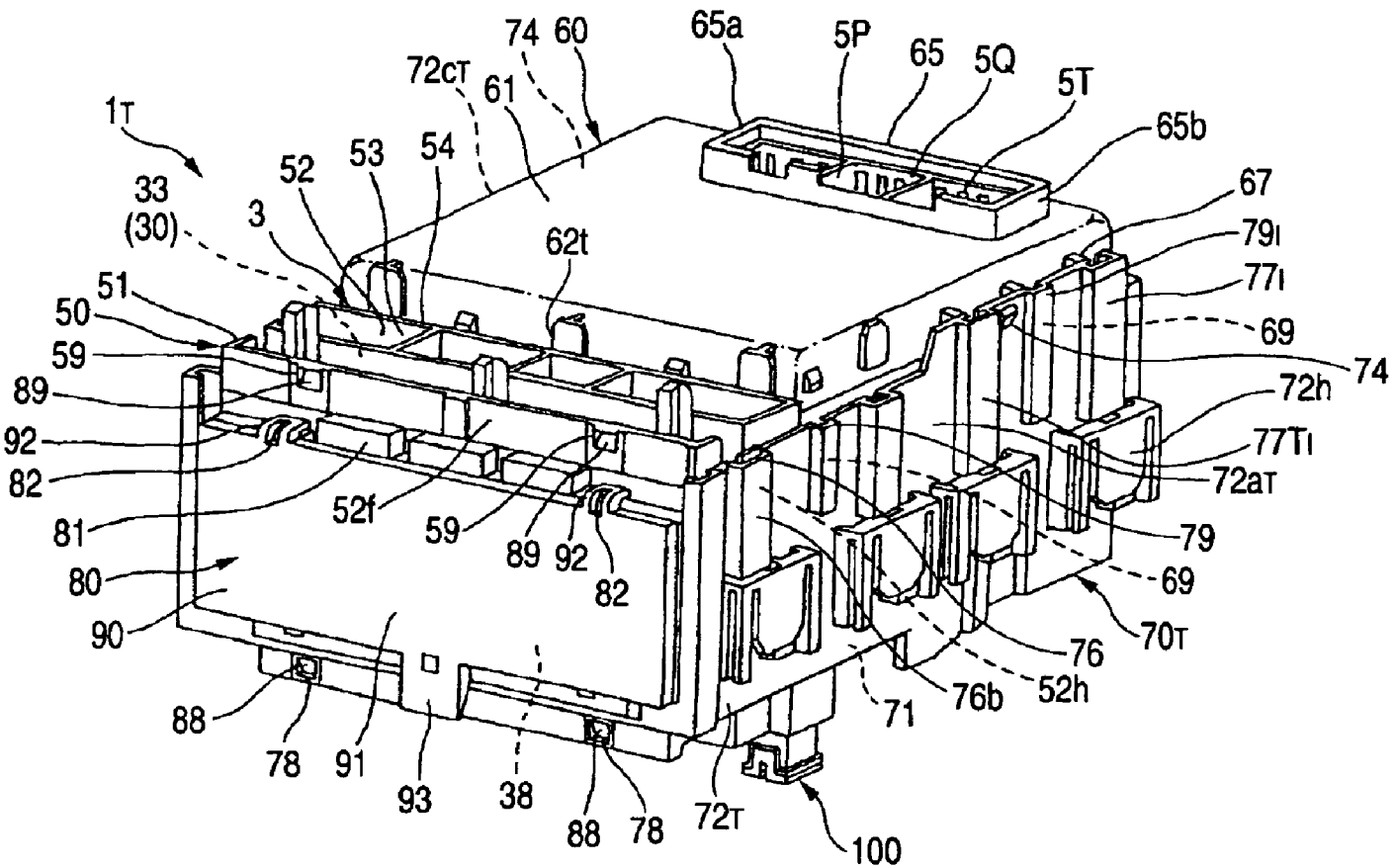
FIG. 7 is a perspective view showing the electric distribution box in its assembled condition.

When the electric distribution box $\mathbf{1}_T$ is completely assembled, the cover 60 is completely fixed to the distribution box body $\mathbf{70}_T$ as shown in FIG. 7. With this construction, the provisional cover (not shown) is not needed in the process of assembling the electric distribution box $\mathbf{1}_T$, and the number of the component parts, required when assembling the electric distribution box $\mathbf{1}_T$, does not increase, and the group of terminals 36 and so on, provided on the wiring board 10, can be positively protected. Although one example of the method of assembling the electric distribution box has been described by way of the assembling procedure of the electric distribution box, other methods, depending on other assembling procedures of the electric distribution box, can be used.

As shown in FIG. 6, this electric distribution box $\mathbf{1}_T$ has such a structure that external wire harnesses (not shown), provided on the upper side of the distribution box body $\mathbf{70}_T$, are electrically connected via a connector portion 3 and a plurality of bus bars 30 to the electronic unit 5 provided at the upper portion of the interior of the distribution box body $\mathbf{70}_T$.

Figure 9:
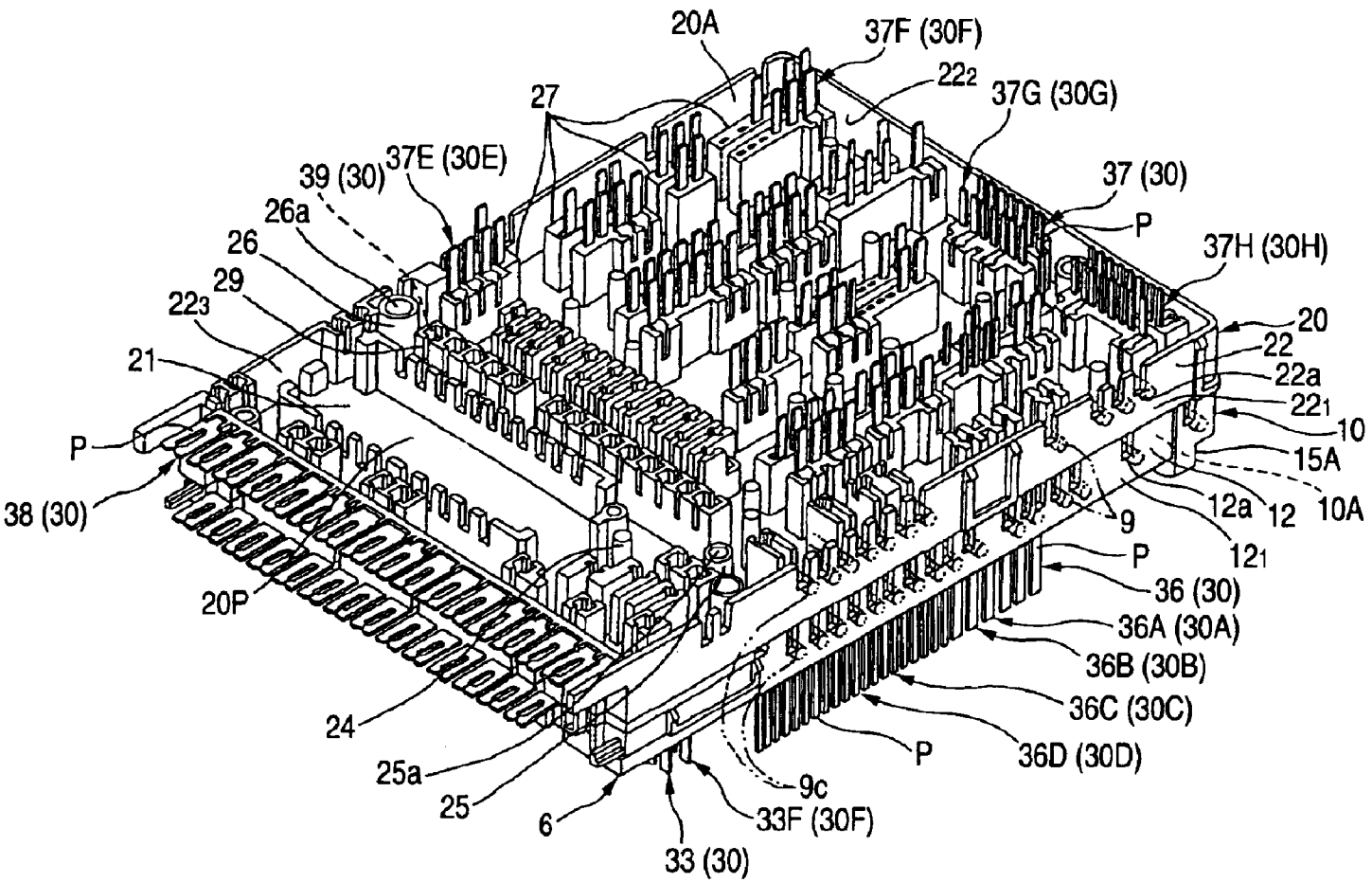
FIG. 9 is a perspective view showing the reverse side of the interior parts.
Figure 10:
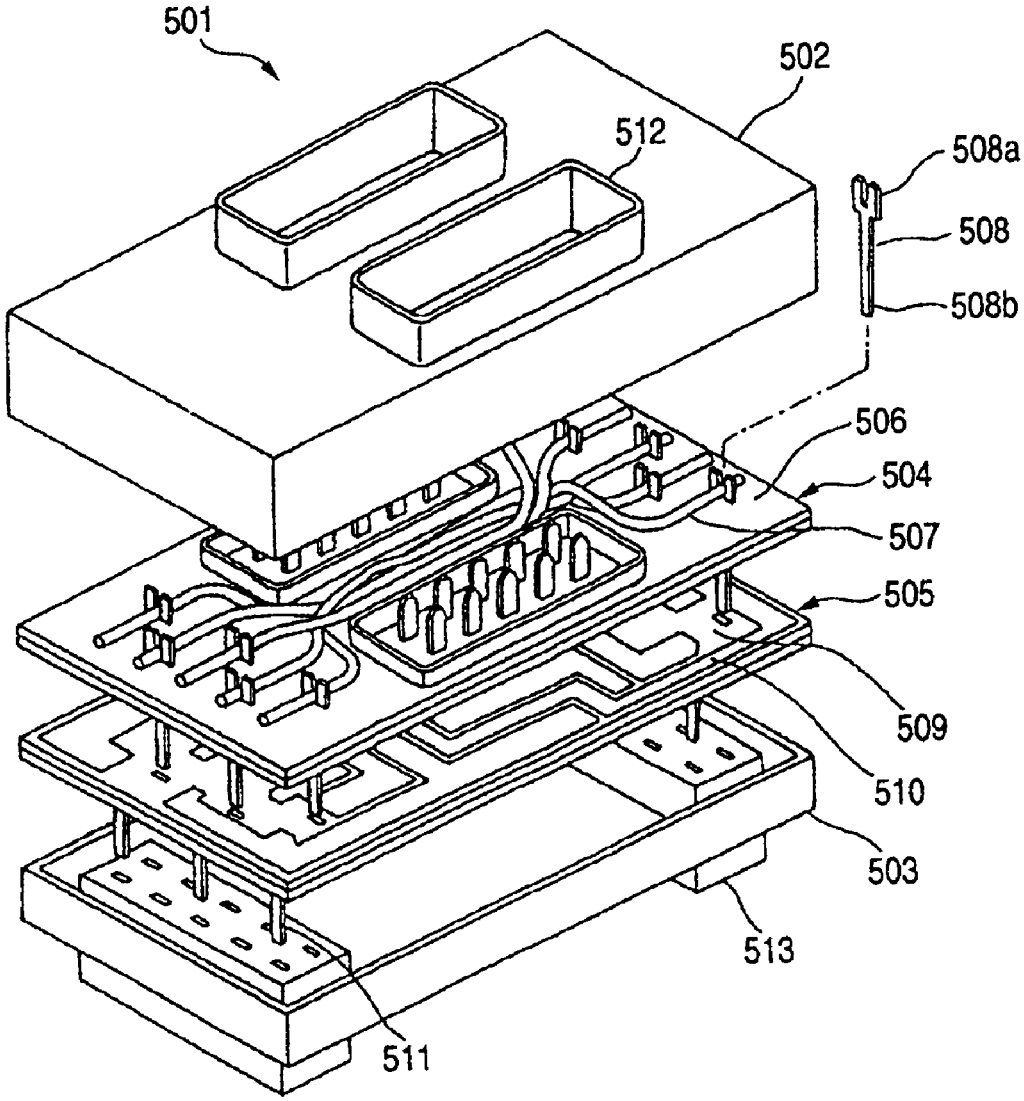
FIG. 10 RELATED ART
FIG. 10 is an exploded, perspective view showing the related electric distribution box.

As shown in FIGS. 8 and 9, male terminals 36 are formed at one end portions of bus bars 30, respectively. The other end portions of the bus bars 30 are electrically connected respectively to wires 9 installed on the wiring boards 10 and 20 (FIG. 9), so that electric circuits are formed at the wiring boards 10 and 20.

Part of mating terminals (not sown), provided in the connector 5L mounted on the electronic unit 5 as shown in FIG. 6, are soldered respectively to the corresponding circuit conductors 5B on the board 5A of the electronic unit 5, and therefore are electrically connected to these circuit conductors 5B. Thus, the connector 5L is used as a connector for PCB.

The wiring board 10 and the electronic unit 5 are positively electrically connected together via the male terminals 36 (formed at the one end portions of the bus bars 30 provided at the wiring board 10) and the mating terminals (not shown) provided in the PCB connector 5L mounted on the electronic unit 5, so that the electric circuits, provided in the electric distribution box $\mathbf{1}_T$ can function properly.

As the interior parts received in the distribution box body $\mathbf{70}_T$ (shown in FIG. 6), there are used the wiring board 10 (FIG. 8) having the plurality of male terminals 36 extending upwardly therefrom, the housing member 50 mounted on the wiring board 10, the other wiring board 20 (FIG. 9) connected to the wiring board 10, and the electronic unit 5 (FIG. 6) including the connector 5L having the mating terminals (not shown) corresponding respectively to the plurality of upwardly-extending male terminals 36.

As shown in FIGS. 8 and 9, the two wiring boards (interior parts) 10 and 20 are combined together, and the thus combined wiring boards 10 and 20 are received in a receiving portion 73 of the distribution box body 70 shown in FIG. 6. As shown in FIG. 8, the bus bars 30 are mounted on the upper wiring board 10 on which the housing member 50 and the electronic unit 5 (FIG. 6) are mounted. As shown in FIG. 9, the bus bars 30 are mounted on the lower wiring board 20 connected to the upper wiring board 10. Other electronic unit 4 (shown in FIG. 8) is mounted in a receiving portion 20P of the wiring board 20 shown in FIG. 9.

As shown in FIG. 9, metal bus bars 30E, 30F, 30G and 30H, having their respective electrical contact portions 37E, 37F, 37G and 37H of various shapes, are mounted on the wiring board 20 made of a synthetic resin. A portion of each of the bus bars 30F and 30H is bent into a generally crank-shape, and the electrical contact portions 37F and 37H are formed at the bus bars 30F and 30H, respectively. The electrical contact portions 37G and 37H of the bus bars 30G and 30H are smaller in width than the electrical contact portions 37E and 37F of the bus bars 30E and 30F.

As shown in FIGS. 8 and 9, metal bus bars 30A, 30B, 30C and 30D, having their respective electrical contact portions 36A, 36B, 36C and 36D of various shapes, are mounted on the wiring board 10 made of a synthetic resin. The electrical contact portions 36C and 36D of the bus bars 30C and 30D are smaller in width than the electrical contact portions 36A and 36B of the bus bars 30A and 30B.

For forming the various bus bars, for example, elongate metal terminal blanks of various shapes are formed from a flat metal sheet by the use of a pressing machine or the like, and thereafter each metal terminal blank is formed into a predetermined shape by a pressing operation such as a bending operation.

The bus bars 30A, 30B, 30C, 30D, 30E, 30F, 30G and 30H (FIG. 9) of the various shapes are representatively designated by reference numeral 30. Terminal portions 33F of the bus bars 30, mated with a housing body 51 of the housing member 50 (FIG. 8), are representatively designated by reference numeral 33. The electrical contact portions 36A, 36B, 36C and 36D (FIGS. 8 and 9) of the various shapes, which are mated with a projecting piece portion 55 of the housing member 50, are representatively designated by reference numeral 36. The electrical contact portions 37E, 37F, 37G and 37H (FIG. 9) of the various shapes are representatively designated by reference numeral 37.

As shown in FIGS. 8 and 9, each of the bus bars 30 is tin-plated as at P. By thus applying a plating treatment to the various bus bars 30, the terminal portions 33 and 36, the electrical contact portions 37, tuning-fork terminal portions 38 or press-contacting terminal portions 39, when electrically contacted with their mating terminals or mating electrical contact portions, their contact stability and connectability are enhanced. And besides, the electrically-connectable portions are prevented from oxidation.

When the plating treatment is applied to at least one or both of the two mating terminal portions or electrical contact portions in order to enhance the weldability and the contact stability, the corrosion resistance of the terminal portion or the electrical contact portion is enhanced. When each elongate bus bar 30 is beforehand coated with a plating material P such as tin-plating P over an entire length thereof, the bus bar 30 is prevented from corrosion. As a result, in use, each bus bar 30 can maintain the stable performance for a long period of time.

Tin has a silver-white color and a metallic luster, and is excellent in ductility and malleability. Tin is oxidized when it is heated at high temperature in the atmosphere, but tin will not rust at normal temperature. Therefore, tin will not lose its luster. Thus, tin has such a nature that it is hardly changed in the air, and therefore when tin-plating is applied to the surface of a shaped member of metal such as iron, steel and copper, the corrosion of the shaped metal member will not proceed, and the shaped metal member is protected by the tin-plating coating over a long period of time.

According to the specifications of the wiring boards and electric distribution box, the bus bars are not subjected to the plating treatment such as tin-plating, in which case the bus bars with no plating are used.

As shown in FIG. 9, many holding portions 29 for respectively receiving the press-contacting terminal portions 39 of the metal bus bars 30, as well as many holding portions 27 for respectively receiving the tab-like electrical contact portions 37 of the metal bus bars 30, are formed at the reverse sides of the synthetic resin-molded wiring boards 10 and 20. A plurality of generally-cylindrical fixing portions 25 and 26 are formed on the reverse side of a base plate portion 21 of the wiring board 20 so that the wiring boards 10 and 20 and so on can be positively fixed to a base wall of the distribution box body through these fixing portions. A fixing hole 25*a* is formed in each of the fixing portions 25, and a fixing hole 26*a* is formed in each of the fixing portions 26, and a fastening element such as a screw is passed through the fixing hole 25*a*, 26*a*.

The press-contacting terminal portions 39 of the bus bars 30 are received in receiving portions of the holding portions 29 (shown in FIG. 9), respectively. Wires 9, press-contacted with the respective press-contacting terminal portions 39, are passed through and held in the holding portions 29, respectively. The wire 9 (that is, the wiring member 9) includes a circuit conductor (not shown) formed by twisting a plurality of thin soft copper wire elements together, and the circuit conductor (not shown) is covered with an insulating sheath (not shown) made of polyvinyl chloride, so that the wire 9 has a linear body of a generally round cross-section.

When the wires 9 are installed on the wiring boards 10 and 20, the wires 9 are suitably bent around side surfaces of cylindrical projected portions 24 formed on the wiring board 20, and by doing so, the direction of extending of each wire 9, installed on the wiring board 20, can be changed. The wiring boards 10 and 20 are used as wiring sheets.

As shown in FIG. 8, the upper wiring board 10 includes a horizontal generally-rectangular base plate portion 11, and vertical side plate portions $\mathbf{12}_1$, $\mathbf{12}_2$ and $\mathbf{12}_3$ formed at a peripheral edge portion of the horizontal generally-rectangular base plate portion 11. A plurality of wires 9 are installed on the wiring board 10. End portions 9*c* of the plurality of wires 9, forming circuits, are collectively disposed at one side plate portion $\mathbf{12}_1$ of the side plate portion 12 of the wiring board 10. As shown in FIG. 9, the end portions 9*c* of the majority of the wires 9 are collectively disposed at one side plate portion $\mathbf{12}_1$ of the wiring board 10.

The lower wiring board 20 includes the horizontal generally-rectangular base plate portion 21, and vertical side plate portions $\mathbf{22}_1$, $\mathbf{22}_2$ and $\mathbf{22}_3$ formed at a peripheral edge portion of the horizontal generally-rectangular base plate portion 21. A plurality of wires 9 are installed on the wiring board 20. End portions 9*c* of the plurality of wires 9, forming circuits, are collectively disposed at one side plate portion $\mathbf{22}_1$ of the side plate portion 22 of the wiring board 20. The end portions 9*c* of the majority of the wires 9 are collectively disposed at one side plate portion $\mathbf{22}_1$ of the wiring board 20.

As shown in FIGS. 8 and 9, a plurality of mounting portions 22*a*, corresponding to the end portions 9*c* of the wires 9, are formed at the one side plate portion $\mathbf{22}_1$ of the wiring board 20, and the end portions 9*c* of the plurality of wires 9 are fixed to the plurality of mounting portions 22*a*, respectively. Similarly, a plurality of mounting portions 12*a*, corresponding to the end portions 9*c* of the wires 9, are formed at the one side plate portion $\mathbf{12}_1$ of the wiring board 10, and the end portions 9*c* of the plurality of wires 9 are fixed to the plurality of mounting portions 12*a*, respectively.

As shown in FIG. 9, each of the mounting portions 22*a*, formed at the one side plate portion $\mathbf{22}_1$ of the wiring board 20, is in the form of a groove 22*a* of a generally U-shaped contour for holding the end portion 9*c* of the wire 9, and the end portion 9*c* of the wire 9 is press-fitted in the generally U-shaped groove 22*a*. Similarly, each of the mounting portions 12*a*, formed at the one side plate portion $\mathbf{12}_1$ of the wiring board 10, is in the form of a groove 12*a* of a generally U-shaped contour for holding the end portion 9*c* of the wire 9, and the end portion 9*c* of the wire 9 is press-fitted in the generally U-shaped groove 12*a*.

As shown in FIGS. 8 and 9, end surfaces (that is, cutting surfaces formed by a cutting tool (not shown) such as a cutter), formed respectively at the end portions 9*c* of the wires 9, are disposed outwardly of the horizontal base plate portion 11 and vertical side plate portion 12 (formed at the peripheral edge portion of the base plate portion 11) of the upper wiring board 10 (FIG. 9). Also, end surfaces (that is, cutting surfaces formed by the cutting tool (not shown)), formed respectively at the end portions 9*c* of the wires 9, are disposed outwardly of the horizontal base plate portion 21 and vertical side plate portion 22 (formed at the peripheral edge portion of the base plate portion 21) of the lower wiring board 20.

When the plurality of wires 9 are thus installed on the wiring board 10, 20, any of the cutting surfaces, formed respectively at the end portions 9*c* of the wires 9, is not disposed within a wiring area 10A, 20A of the wiring board 10, 20. The wiring area 20A means a wire-installing portion which is provided within the wiring board 20, and is defined by the base plate portion 21 and the side plate portions $\mathbf{22}_1$, $\mathbf{22}_2$ and $\mathbf{22}_3$ as shown in FIG. 9.

As shown in FIG. 8, the tab-like terminal portion 36 is formed at one end of the metal bus bar 30. The tab-like terminal portion 33 is formed at the other end of the metal bus bar 30. The tab-like terminal portions 33, projecting from or passing through the power module 6, and the terminal portions 36, projecting from the synthetic resin-molded wiring board 10, extend upwardly relative to the synthetic resin-molded distribution box body $\mathbf{70}_T$ (FIG. 6) on which these are mounted. "A module" means is a unit forming part of an apparatus, a machine or a system, and is formed as a functional unit.

As shown in FIG. 8, the projecting piece portion 55 extends from one side of a peripheral wall 52 of the synthetic resin-molded housing member 50, and the housing body 51 and the projecting piece portion 55 are molded integrally with each other, using a synthetic resin. The projecting piece portion 55 is in the form of a thin plate-like member of a generally inverted L-shape.

As shown in FIG. 8, a step portion 55*j* is formed on a thinned portion 55*n* of the projecting piece portion 55 to form a thickened portion 55*m* on the projecting piece portion 55 of the housing member 50. The thinned portion 55*n* and thickened portion 55*m* of the projecting piece portion 55 are molded integrally with each other, using the same synthetic resin. Cavities 56 for respectively passing the terminal portions 36 of the bus bars 30 therethrough are formed through the thickened portion 55*m* of the projecting piece portion 55. A cavity means a vacant space, a hollow portion or a through hole. A separate molded member, serving as a separate thickened portion (55*m*), can be mounted on the projecting piece portion 55.

When the synthetic resin-molded housing member 50 is mounted on the distribution box body $\mathbf{70}_T$ of the electric distribution box $\mathbf{1}_T$, the power module 6 and the synthetic resin-molded wiring board 10, the tab-like metal terminal portions 33 project into a receiving portion 53 of the housing body 51 of the housing member 50, and is received therein, thereby forming the connector portion 3. As shown in FIG. 8, the terminal portions 33 are disposed within an opening 54 in the receiving portion 53 of the housing body 51.

The connector portion 3 is formed, and also the plurality of terminal portions 36, projecting upwardly from the wiring board 10, are passed respectively through the cavities 56 formed through the projecting piece portion 55 of the housing member 50. At this time, the plurality of terminal portions 36, which have not been properly positioned, and therefore have been tilted, are inserted respectively into the cavities 56 in the projecting piece portion 55 of the housing member 50 as shown in FIGS. 6 and 8. As a result, the plurality of terminal portions 36 are corrected in posture, and are arranged generally on a straight line. Also, the thus corrected terminal portions 36 are electrically connected respectively to the terminals (not shown) of the connector 5L (FIG. 6) mounted on the electronic unit 5.

As shown in FIG. 6, the electronic unit 5, the wiring board 10, etc., are mounted within the receiving portion 73 of the distribution box body $\mathbf{70}_T$. Part of the housing member 50, such as the projecting piece portion 55 of the housing member 50, are disposed within the distribution box body $\mathbf{70}_T$, while the housing body 51 of the housing member 50 is exposed to the exterior of the distribution box body $\mathbf{70}_T$ as shown in FIG. 7. The connector portion 3 is provided at the outside of the electric distribution box $\mathbf{1}_T$ so that the external wire harnesses (not shown) can be easily connected to this connector portion 3.

In order that the power module 6 can be easily mounted on the upper wiring board 10, a stepped portion 11B is formed at the base plate portion 11 of the upper wiring board 10, and other base plate portion 11A, corresponding in shape to a base plate portion 6A of the power module 6, extends from the base plate portion 11 of the wiring board 10 in such a manner that the other base plate portion 11A is disposed at a level lower than the upper base plate portion 11. The upper base plate portion 11 and lower other base plate portion 11A of the wiring board 10 are interconnected by the stepped portion 11B, and are molded integrally with each other.

As shown in FIG. 8, positioning portions 15B of a generally cylindrical shape are formed on the other base plate portion 11A of the upper wiring board 10. The generally-cylindrical positioning portions 15B, formed on the other base plate portion 11A of the wiring board 10, project upwardly beyond the base plate portion 6A of the power module 6. In order that the housing member 50 can be easily mounted on the power module 6 and the upper wiring board 10, the generally-cylindrical positioning portions 15B extend upwardly respectively through circular holes (not shown) formed in the base plate portion 6A of the power module 6. A plurality of positioning portions 55*b* (each in the form of a generally-circular hole), corresponding respectively to the plurality of generally-cylindrical positioning portions 15B, are formed in the projecting piece portion 55 of the housing member 50.

In order that the housing member 50 can be mounted on the base plate portion 11 of the upper wiring board 10 in a properly positioned manner, a plurality of generally-cylindrical positioning portions 11*h* are formed on the base plate portion 11 of the wiring board 10. A plurality of positioning portions 55*h* (each in the form of a generally-circular hole), corresponding respectively to the plurality of generally-cylindrical positioning portions 11*h*, are formed in the projecting piece portion 55 of the housing member 50.

A plurality of fixing portions 55*d* (each in the form of a generally-circular hole) are formed in the projecting piece portion 55 of the housing member 50, and a plurality of fixing portions 6D (each in the form of a generally-circular hole) are formed in the base plate portion 6A of the power module 6. A plurality of other fixing portions (not shown) of a generally-cylindrical shape, corresponding respectively to the fixing portions 6D and also respectively to the fixing portions 55*d*, are formed on the other base plate portion 11A of the wiring board 10. As shown in FIG. 9, a plurality of fixing portions 26 of a generally-cylindrical shape are formed on the base plate portion 21 of the lower wiring board 20, and the electronic unit 4 is provided in the receiving portion 20P of the wiring board 20, and generally-cylindrical fixing portions (not shown) (each in the form of a generally-circular hole) are formed in a base plate portion of the electronic unit 4. Elongate fastening elements (not shown), such as screws, are passed through these fixing portions, and for example, screw portions of these fastening elements are threaded respectively into fixing portions (not shown) formed on the bottom wall 71 of the distribution box body $\mathbf{70}_T$ (FIG. 6), and by doing so, the housing member 50, the power module 6, the upper wiring board 10, the lower wiring board 20 and the electronic unit 4 are positively fixed to the distribution box body $\mathbf{70}_T$.

In order that the electronic unit 5 (shown in FIG. 6) can be positively mounted within the electric distribution box $\mathbf{1}_T$, a plurality of fixing portions 15A, each having a fixing hole $\mathbf{15A}_L$, are formed on the upper side of the base plate portion 11 of the wiring board 10 as shown in FIG. 8. Also, the plurality of fixing portions 15B, each having a fixing hole $\mathbf{15B}_L$, are formed on the other base plate portion 11A of the wiring board 10.

The generally-cylindrical fixing portions 15B, formed on the upper side of the other base plate portion 11A of the wiring board 10, serve also as the positioning portions 15B by which the mounting directions of the power module 6 and housing member 50 can be easily recognized. A plurality of portions 5V (each having a generally-cylindrical fixing hole $\mathbf{5V}_L$), corresponding respectively to the plurality of generally-cylindrical fixing portions 15A and 15B, are formed in the board portion 5A of the electronic unit 5 as shown in FIG. 6.

When the electronic unit 5 is mounted on the upper side of the wiring board 10, the plurality of male terminals 36, provided at the projecting piece portion 55 on the wiring board 10, are electrically connected respectively to the mating terminals (not shown) provided at the connector 5L of the electronic unit 5.

More specifically, the terminal portions 36, projecting upwardly from the upper wiring board 10 and the projecting piece portion 55 of the housing member 50, are connected respectively to the terminals (not shown) of the connector 5L provided at the electronic unit 5, and also the fixing holes $\mathbf{15A}_L$ of the fixing portions 15A (formed on the base plate portion 11 of the wiring board 10) and the fixing holes $\mathbf{15B}_L$ of the fixing portions 15B (formed on the other base plate portion 11A of the wiring board 10) are aligned with the respective fixing holes $\mathbf{5V}_L$ formed in the board portion 5A of the electronic unit 5. Then, fastening elements (not shown), such as screws, are inserted respectively into the fixing holes $\mathbf{5V}_L$ formed in the board portion 5A of the electronic unit 5, and further are passed respectively through the corresponding fixing holes $\mathbf{15A}_L$ and $\mathbf{15B}_L$ (FIG. 8) of the fixing portions 15A and 15B (The fixing portions 15A are formed on the base plate portion 11 of the wiring board 10, and the fixing portions 15B are formed on the other base plate portion 11A). Further, for example, screw portions (not shown) of these fastening elements are threaded respectively into the fixing holes 25*a* of the fixing portions 25 shown in FIG. 9, and by doing so, the electronic unit 5 is positively fixed to the wiring boards 10 and 20.

In the electric distribution box $\mathbf{1}_T$ of this structure, the wiring board 10 and the electronic unit 5 can be easily and positively electrically connected together. And besides, during the process of assembling the electric distribution box $\mathbf{1}_T$, the plurality of male terminals 36, extending upwardly from the wiring board 10 provided within the distribution box body $\mathbf{70}_T$, are positively protected by the cover 60 (shown in FIGS. 4 and 5) provisionally fixed to the distribution box body $\mathbf{70}_T$ shown in FIG. 6.

The connector portion 3 and the electronic unit 5 are juxtaposed to each other in adjoining relation to each other at the upper layer side of the distribution box body $\mathbf{70}_T$ where the connector portion 3 and the electronic unit 5 are provided. The connector portion 3 and the electronic unit 5 are juxtaposed to each other above the wiring board 10 mounted in the receiving portion 73 of the distribution box body $\mathbf{70}_T$.

In the electric distribution box $\mathbf{1}_T$ of this arrangement structure, the electronic unit 5 can be easily mounted on the distribution box body $\mathbf{70}_T$. When connecting the connectors (not shown) of the external wire harnesses (not shown) to the connector portion 3 of the electric distribution box $\mathbf{1}_T$ shown in FIG. 7, this connecting operation can be carried out easily.

As shown in FIGS. 6 and 7, the fuse block 80 is provided at the front side of the electric distribution box $\mathbf{1}_T$. The fuse block is a block-like part in which a plurality of fuses are mounted in a mating mounting member (such as a housing, a base or a holder) to form a unit.

The fuse block 80 includes a synthetic resin-molded front cover 90 for protecting the fuses (not shown). This front cover 90 includes a cover body 91, a pair of hinge portions 92 detachably connected to a fuse block body 81, and an operating portion 93 which is provided at a lower side of the cover body 91 so as to enable the front cover 90 to be easily opened and closed relative to the synthetic resin-molded fuse block body 81.

The pair of hinge portions 92, formed at the upper side of the front cover 90, are connected respectively to a pair of hinge portions 82 formed at the front side of the fuse block body 81, and by doing so, the front cover 90 is mounted on the fuse block body 81 so as to be opened and closed. Since the front cover 90 is thus mounted on the front side of the fuse block body 81 so as to be opened and closed, the maintenance, such as the exchange of the fuses (not shown) provided within the fuse block body 81, can be carried out easily.

A pair of retaining portions 88 (each having a retaining projection 88) are formed at a lower portion of the front side of the fuse block body 81, while a pair of retaining portions 89 (each having a retaining projection 89) are formed at an upper portion of the front side of the fuse block body 81. A pair of engagement portions 78 (each having an engagement hole 78 of a rectangular shape), corresponding respectively to the pair of retaining portions 88 formed at the lower portion of the front side of the fuse block body 81, are provided at a lower portion of the front side of the distribution box body $\mathbf{70}_T$. A pair of engagement portions 59 (each having an engagement hole 59 of a rectangular shape), corresponding respectively to the pair of retaining portions 89 formed at the upper portion of the front side of the fuse block body 81, are provided at a front wall 52*f* of the housing member 50.

The pair of engagement portions 78, provided at the lower portion of the front side of the distribution box body $\mathbf{70}_T$, are retainingly engaged respectively with the pair of retaining portions 88 provided at the lower portion of the front side of the fuse block body 81, so that the fuse block body 81 is positively mounted on the distribution box body $\mathbf{70}_T$. The pair of retaining portions 89, provided at the upper portion of the front side of the fuse block body 81, are retainingly engaged respectively with the pair of engagement portions 59 provided at the front wall 52*f* of the housing member 50, so that the housing member 50 is attached to the distribution box body $\mathbf{70}_T$ and the fuse block 80 mounted on the distribution box body $\mathbf{70}_T$.

The plurality of layers of tuning-fork terminal portions 38 (shown in FIG. 9) are disposed within the fuse block body 81 shown in FIGS. 6 and 7. The plurality of layers of tuning-fork terminal portions 38 are formed respectively by the extension portions of the various bus bars 30.

When the fuse block 80, having the plurality of blade-type fuses (not shown) received therein, is attached to the front side of the distribution box body $\mathbf{70}_T$ as shown in FIG. 6, tab terminals (not shown) of the blade-type fuses within the fuse block body 81 are electrically connected respectively to the plurality of layers of tuning-fork terminal portions 38 shown in FIG. 9.

Thus, in the electric distribution box $\mathbf{1}_T$ (FIG. 6), the fuse block 80 (FIG. 6), having the blade-type fuses (not shown) received therein, is used, and the tab terminals (not shown) of the blade-type fuses are electrically connected respectively to the plurality of layers of tuning-fork terminal portions 38 shown in FIG. 9. Therefore, the plurality of blade-type fuses (not shown) can be easily and rapidly provided in the electric distribution box $\mathbf{1}_T$. Therefore, the efficiency of the operation for mounting the blade-type fuses (not shown) in the electric distribution box $\mathbf{1}_T$ is enhanced.

According to the specification of the electric distribution box, other terminals (not shown)(for example, tab-like terminals or female terminals) than the plurality of layers of tuning-fork terminal portions 38 can be used.

After the electronic unit 5 is mounted within the distribution box body $\mathbf{70}_T$ as shown in FIG. 6, the cover 60 (shown in FIG. 4) is fitted on the distribution box body $\mathbf{70}_T$, and is attached thereto, so that the electric distribution box $\mathbf{1}_T$ is assembled as shown in FIG. 7.

At this time, the completely-retaining portions 69 of the cover 60 (shown in FIG. 4) are retainingly engaged respectively with the completely-engaging portions 79 of the distribution box body $\mathbf{70}_T$ (shown in FIG. 6), and as a result the cover 60 is positively attached to the distribution box body $\mathbf{70}_T$ in such a manner that the cover 60 will not shake relative to the distribution box body $\mathbf{70}_T$. At the same time, a plurality of engagement portions 62*k*, provided at the side wall 62*d* of the cover 60 (shown in FIGS. 4 and 5), are engaged respectively with a plurality of retaining portions 52*k* provided at the peripheral wall 52 of the housing member 50 shown in FIG. 8.

The electric distribution boxes $\mathbf{1}_T$, shown in FIG. 7, are delivered as products to car manufacturers and others. The electronic unit 5 (shown in FIG. 6) may be mounted on the distribution box body $\mathbf{70}_T$ of the electronic distribution box $\mathbf{1}_T$ in a car manufacturer or the like. Except when effecting the inspection or repair of the electric distribution box $\mathbf{1}_T$ (shown in FIG. 7), an operation for removing the cover 60, completely locked to the distribution box body $\mathbf{70}_T$, from this distribution box body is hardly effected.

The connectors of the external wire harnesses (not shown) are electrically connected to the connector portion 3 of the electric distribution box $\mathbf{1}_T$ shown in FIG. 7, and also the connectors of the other external wire harnesses (not shown) are connected to the connector portion 5P of the electric distribution box $\mathbf{1}_T$. The electric distribution box $\mathbf{1}_T$ is used as a junction box (abbreviated as "J/B") connectable to electric wiring in an automobile. The electric distribution box can also be used, for example, as a relay box (abbreviated as "R/B") or the like.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An electric distribution box, comprising:

a distribution box body, in which interior parts are mounted, said interior parts including a first part and a second part; and a cover, attached to the distribution box body to protect the interior parts, wherein the cover is completely attachable to the distribution box body in a first position, wherein the cover is provisionally attachable to the distribution box body in a second position different from the first position, and wherein the positioning of said cover in said second provisional position indicates that said first part, and not said second part, is mounted in said distribution box body and wherein the positioning of said cover in said first position indicates that both of said first and second parts are mounted in the distribution box body.

2. The electric distribution box as set forth in claim 1, wherein a mounting direction of the cover relative to the distribution box body when the cover is provisionally fixed to the distribution box body, is reverse to a mounting direction of the cover relative to the distribution box body when the cover is completely fixed to the distribution box body.

3. The electric distribution box as set forth in claim 1, wherein the cover is formed with a first engaging portion;

wherein the distribution box body is formed with a first retaining portion; and wherein the cover is provisionally fixed to the distribution box body by engaging the first engaging portion with the first retaining portion.

4. The electric distribution box as set forth in claim 1, wherein the cover is formed with a first guide portion;

wherein the distribution box body is formed with a first receiving portion corresponding to the first guide portion;

wherein the first guide portion is guided into the first receiving portion at the time of provisionally fixing the cover to the distribution box body; and wherein the first guide portion is guided into the first receiving portion at the time of completely fixing the cover to the distribution box body.

5. The electric distribution box as set forth in claim 1, wherein the cover is formed with a first engaging portion;

wherein the distribution box body is formed with a first retaining portion; and wherein the cover is completely fixed to the distribution box body by engaging the first engaging portion with the first retaining portion.

6. The electric distribution box as set forth claim 5, wherein the first engaging portion is provided on a side wall of the cover; and wherein the first retaining portion is provide on a side wall of the distribution box body.

7. The electric distribution box as set forth in claim 1, wherein the cover is formed with a first guide portion;

wherein the distribution box body is formed with a first receiving portion corresponding to the first guide portion;

wherein the first guide portion is deviated from the first receiving portion at the time of provisionally fixing the cover to the distribution box body; and wherein the first guide portion is guided into the first receiving portion at the time of completely fixing the cover to the distribution box body.

8. The electric distribution box as set forth in claim 7, wherein the cover is formed with an engaging portion;

wherein the distribution box body is formed with a retaining portion;

wherein the cover is provisionally fixed to the distribution box body by engaging the engaging portion with the retaining portion;

wherein the engaging portion is provided on the first guide portion; and wherein the retaining portion is provided on a side wall of the distribution box body.

9. The electric distribution box as set forth in claim 1, wherein a wiring board having upstanding terminals and, an electronic unit including a connector having mating terminals corresponding to the terminals, are served as the interior parts; and wherein the electronic unit is mounted on an upper side of the wiring board so that the terminals are electrically connected to the mating terminals, respectively.

10. The electric distribution box as set forth in claim 9, wherein the terminals are formed respectively at one end portions of bus bars mounted on the wiring board, and the other end portions of the bus bars are connected to a wire installed on the wiring board so as to form electric circuits on the wiring board; and wherein the connector mounted on the electronic unit is served as a PCB connector such that a part of the mating terminals of the connector are soldered to circuit conductors on a board of the electronic unit.

11. A method of assembling an electric distribution box, comprising the steps of:

mounting a first interior part in a distribution box body;

provisionally fixing a cover to the distribution box body to protect the interior part;

removing the cover from the distribution box body;

mounting a second interior part in the distribution box body; and completely fixing the cover to the distribution box body, said steps being performed in the stated order.

12. The method as set forth in claim 11, wherein a mounting direction of the cover relative to the distribution box body in the provisionally fixing step is reverse to a mounting direction of the cover relative to the distribution box body in the completely fixing step.

* * * * *